US007102600B2

(12) United States Patent
Kasai

(10) Patent No.: US 7,102,600 B2
(45) Date of Patent: Sep. 5, 2006

(54) SYSTEM AND METHOD FOR MANUFACTURING A ELECTRO-OPTICAL DEVICE

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 259 days.

(21) Appl. No.: 10/207,965

(22) Filed: Jul. 31, 2002

(65) Prior Publication Data

US 2003/0067455 A1 Apr. 10, 2003

(30) Foreign Application Priority Data

Aug. 2, 2001 (JP) ..... 2001-235385
Jul. 31, 2002 (JP) ..... 2002-223166

(51) Int. Cl.
*G09G 3/30* (2006.01)

(52) U.S. Cl. ..... 345/77; 345/80

(58) Field of Classification Search ..... 345/76, 345/80, 87, 90, 92, 94, 98, 99, 100, 204, 345/208, 211–213
See application file for complete search history.

(56) References Cited

U.S. PATENT DOCUMENTS 4,967,192 A * 10/1990 Hirane et al. ..... 345/211
5,061,861 A * 10/1991 Sameshima et al. ..... 327/109
5,336,879 A 8/1994 Sauer
5,814,980 A * 9/1998 Lewis ..... 323/311
5,903,246 A 5/1999 Dingwall
5,952,789 A 9/1999 Stewart et al.
6,091,203 A 7/2000 Kawashima et al.
6,160,436 A * 12/2000 Runaldue ..... 327/407
6,229,506 B1 5/2001 Dawson et al.
6,359,605 B1 3/2002 Knapp et al.
6,373,455 B1 * 4/2002 Kuribayashi et al. ..... 345/76
6,384,804 B1 * 5/2002 Dodabalapur et al. ..... 345/82
6,433,486 B1 * 8/2002 Yokoyama ..... 315/169.3
6,529,178 B1 3/2003 Kimura
6,535,185 B1 3/2003 Kim et al.
2002/0030647 A1 * 3/2002 Hack et al. ..... 345/82

FOREIGN PATENT DOCUMENTS

CN 1312535 A 9/2001
JP A-2000-267622 9/2000
KR A 2000-0073726 12/2000
TW 413801 12/1989
WO WO 99/65012 12/1999

* cited by examiner

*Primary Examiner*—Amr A. Awad
*Assistant Examiner*—Tom Sheng
(74) *Attorney, Agent, or Firm*—Oliff & Berridge, PLC

(57) ABSTRACT

The invention provides an electronic device that performs driving control of an electro-optical device by current driving at a high precision and reduces the number of components. The invention can include, along a data line to which pixel circuits are connected between a driving power source and a driver, a conversion transistor formed of a diode-connected transistor that is inserted between the driving power source and the pixel circuits. The conversion transistor can be used in common among the pixel circuits. Each pixel circuit can be formed of a driving transistor which forms a current mirror circuit with the conversion transistor, a control transistor driven by a scanning driver, for turning on and off the connection between the conversion transistor and the driving transistor, and a capacitive device for holding a voltage applied to the gate of the driving transistor by the control transistor. The driving transistor causes current corresponding to the voltage held by the capacitive device to flow into an organic electroluminescent device.

62 Claims, 18 Drawing Sheets

(FIG. 1)
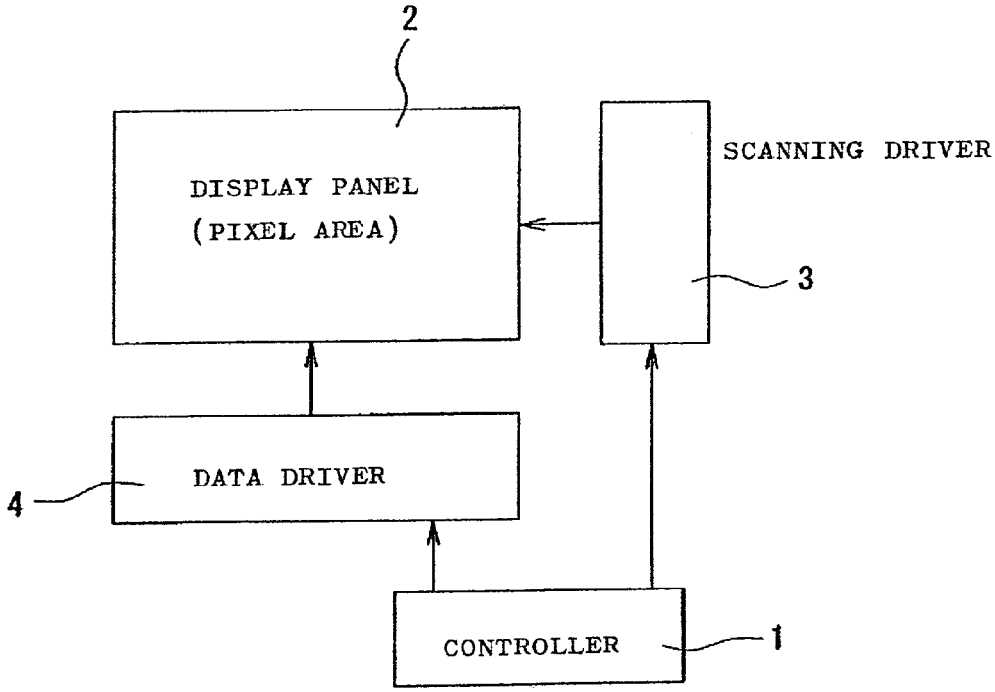

(FIG. 2)
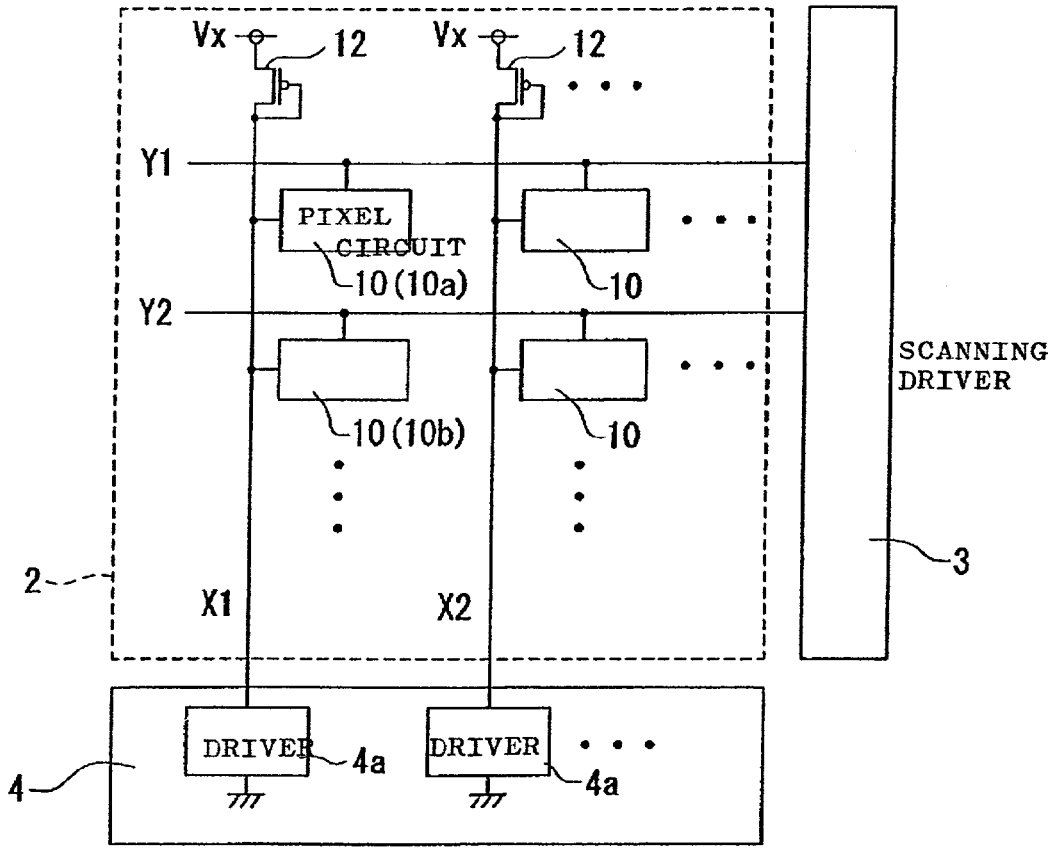

(FIG. 3)
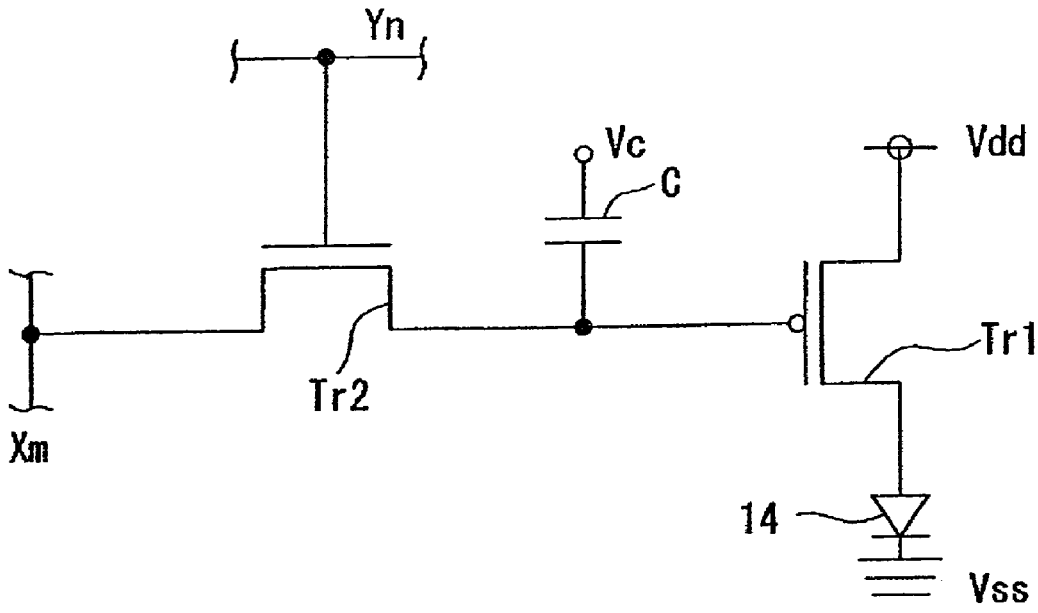

(FIG. 4)
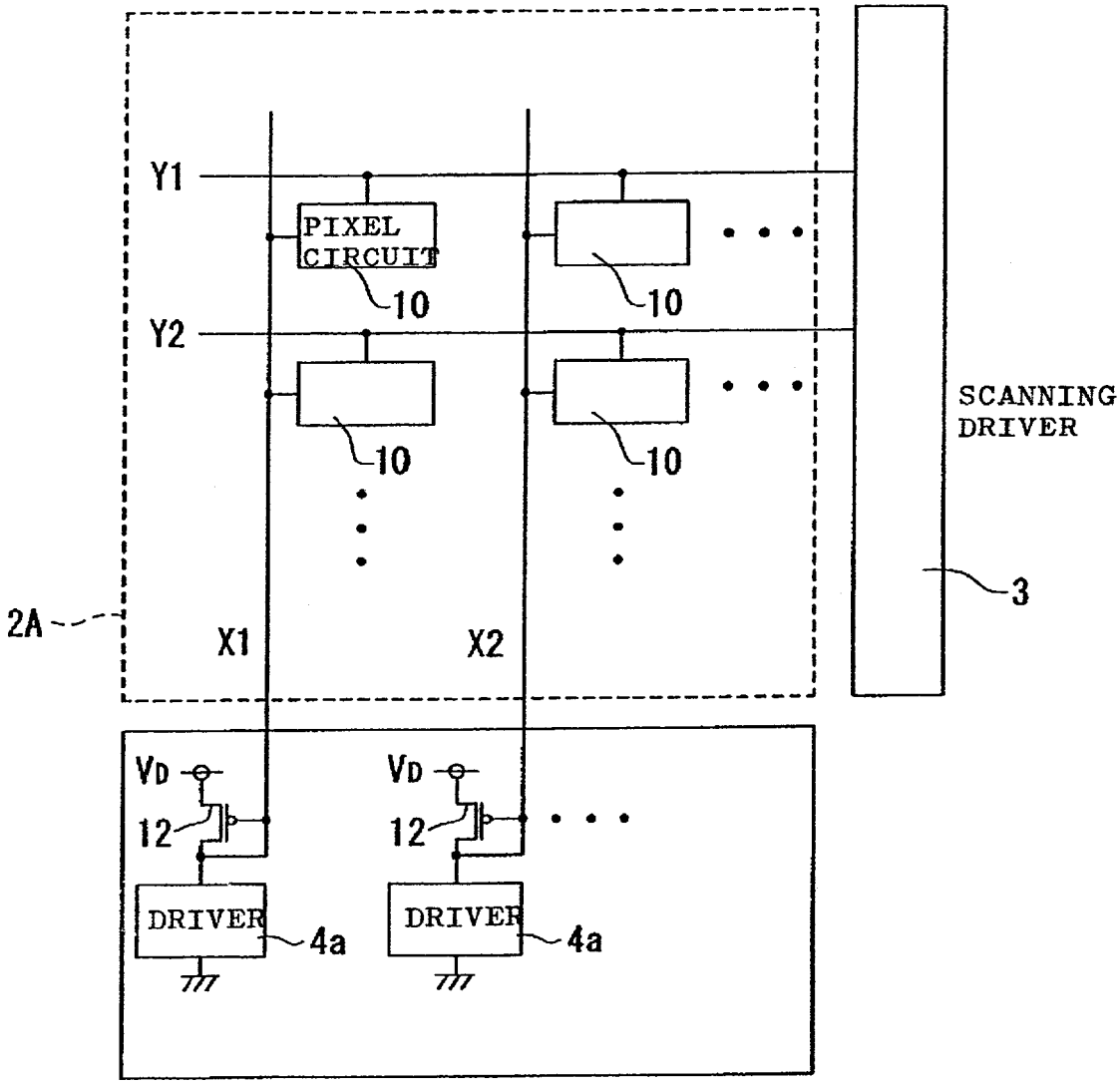

(FIG. 5)
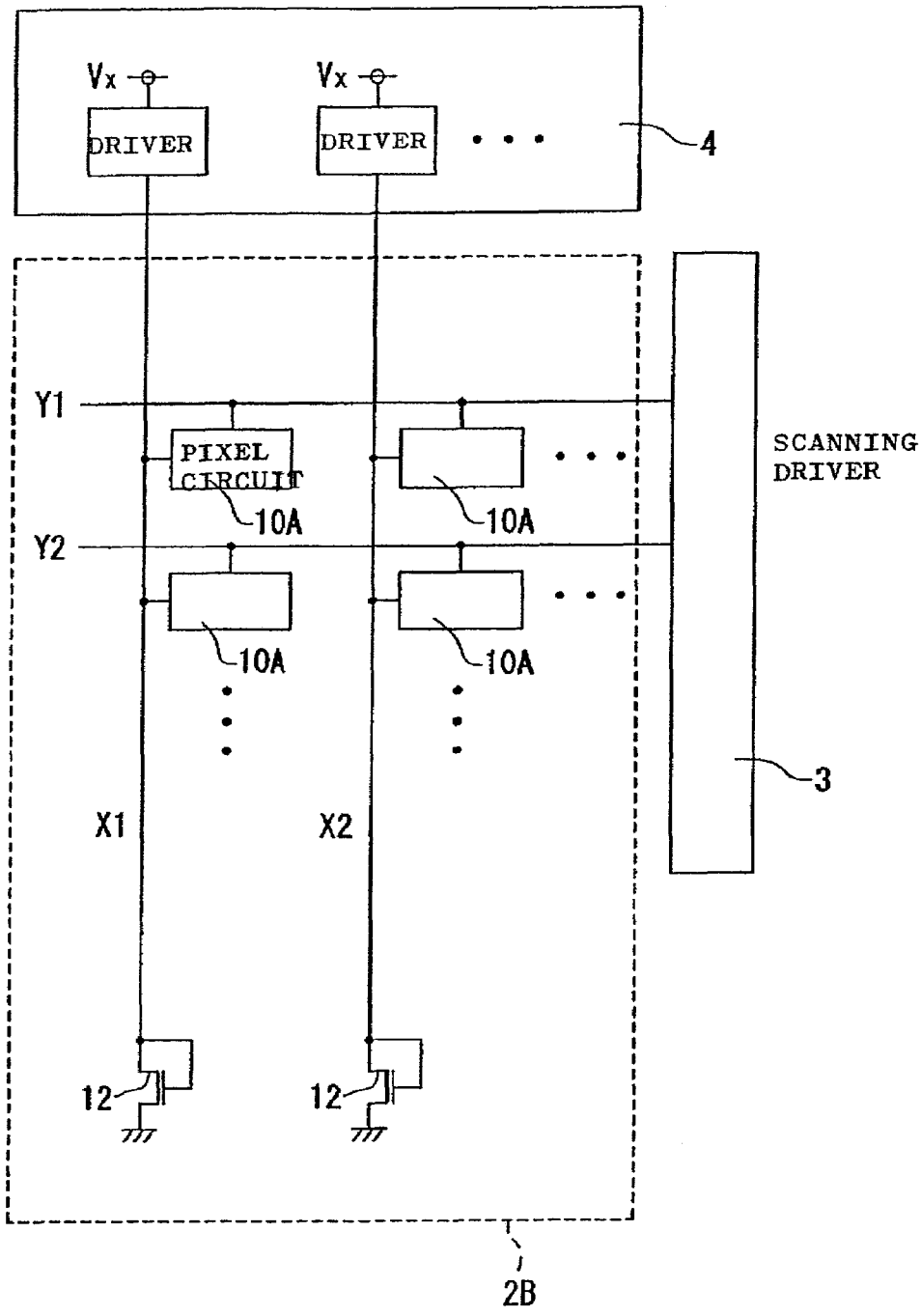

(FIG. 6)
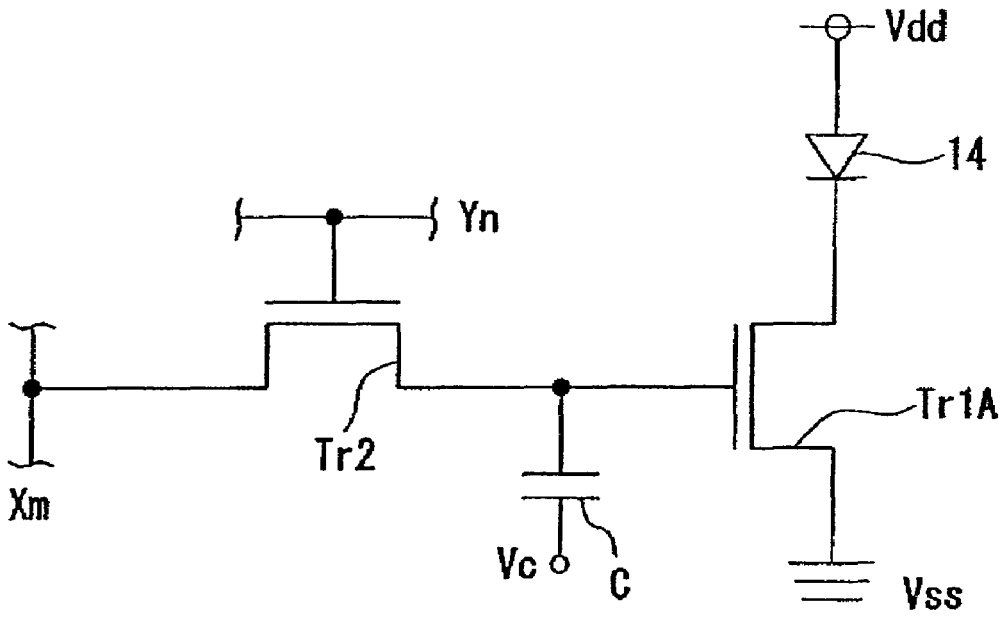

(FIG. 7)
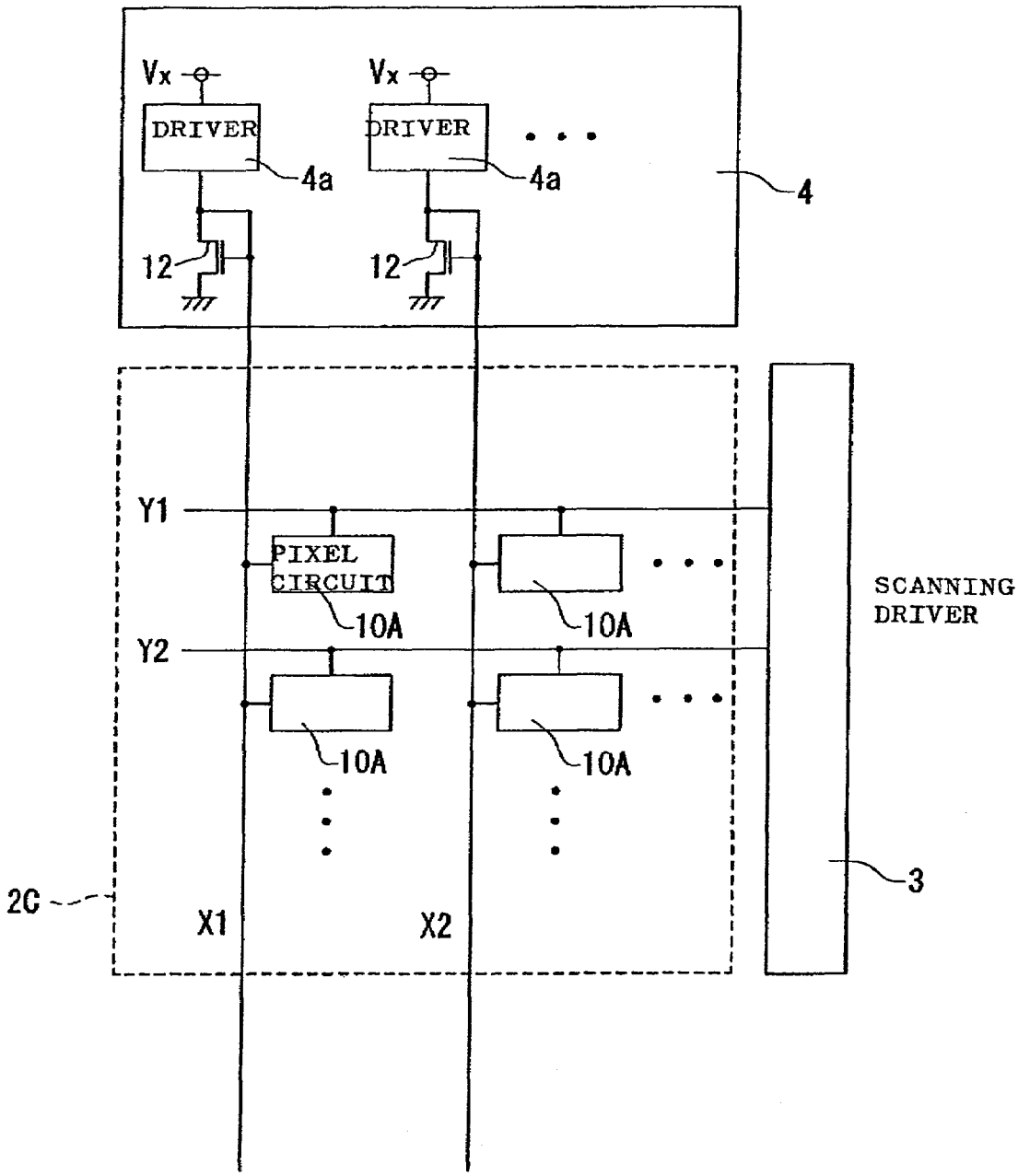

(FIG. 8)
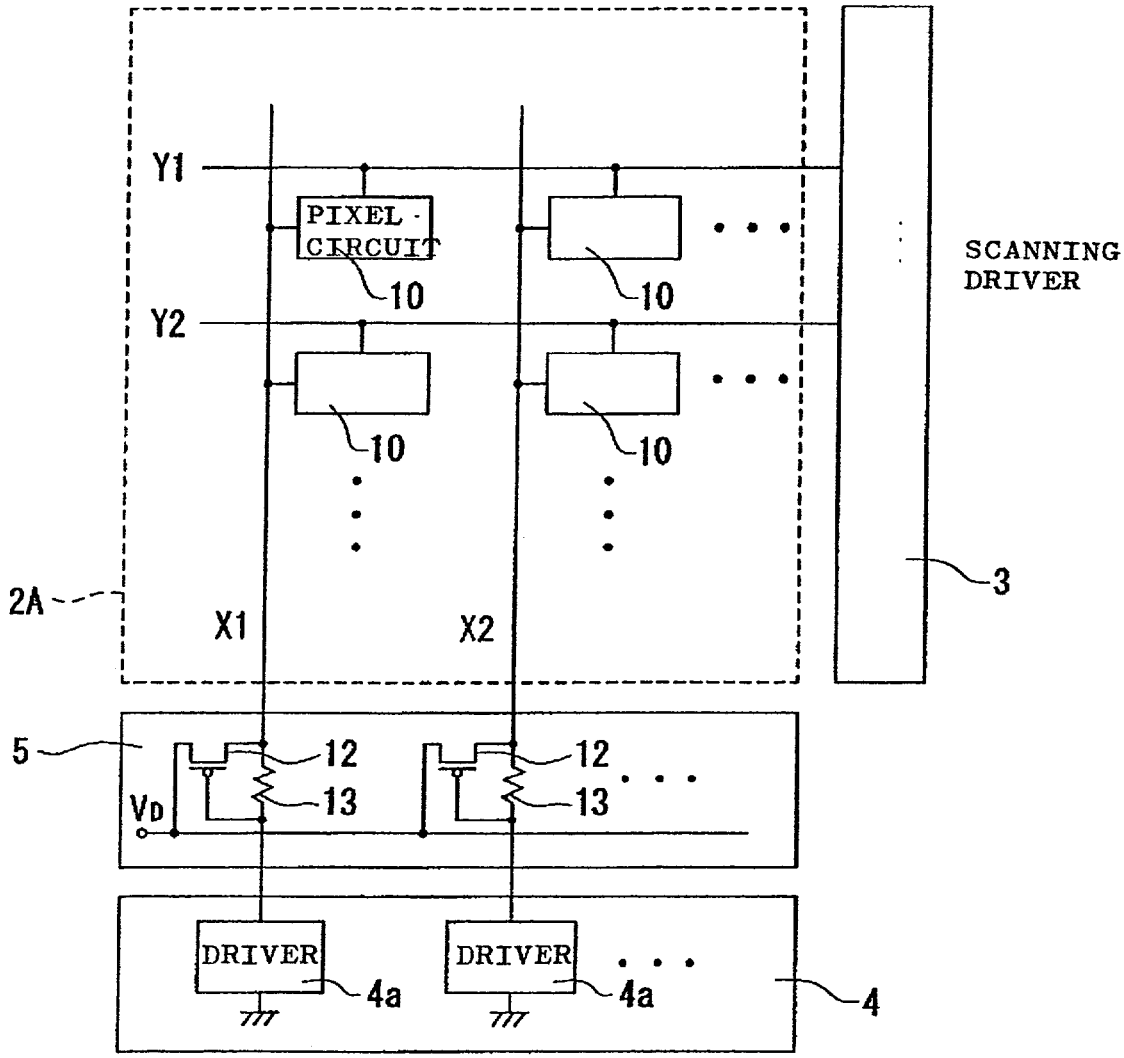

(FIG. 9)
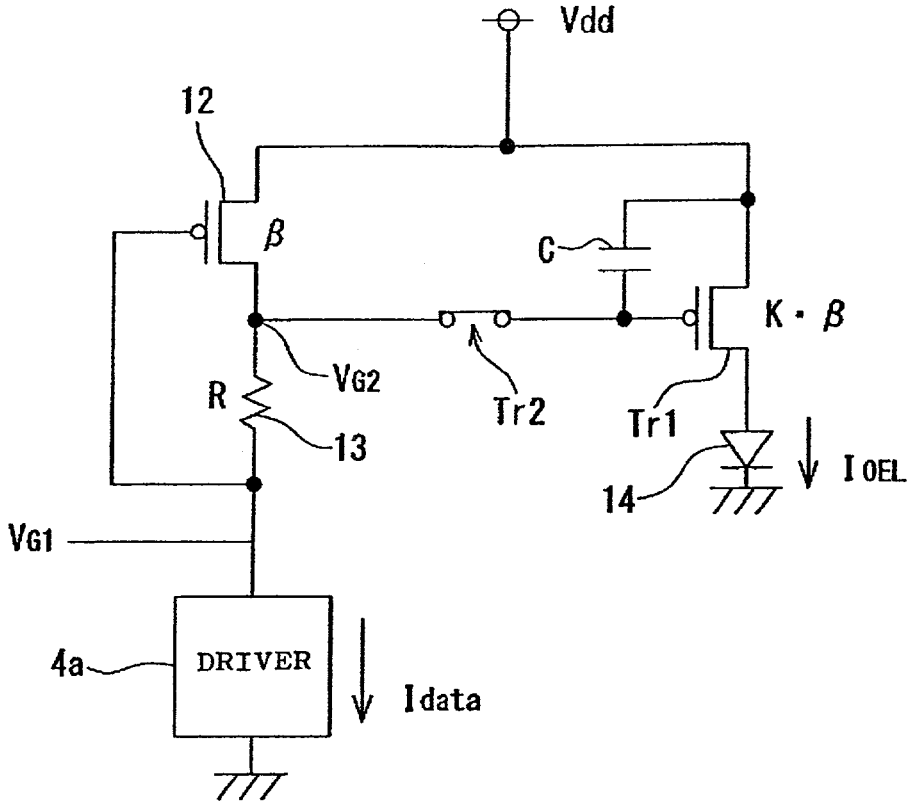
(FIG. 10)
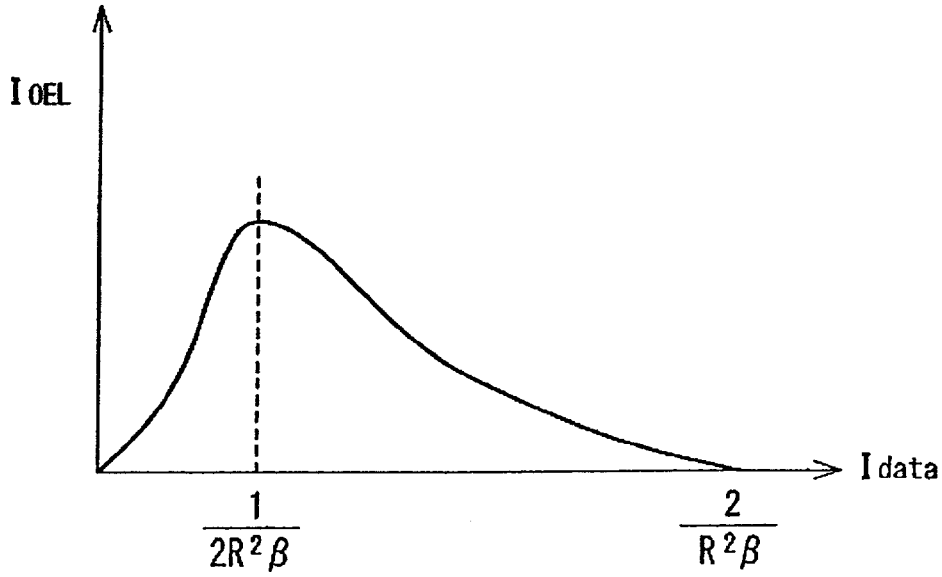

(FIG. 11)
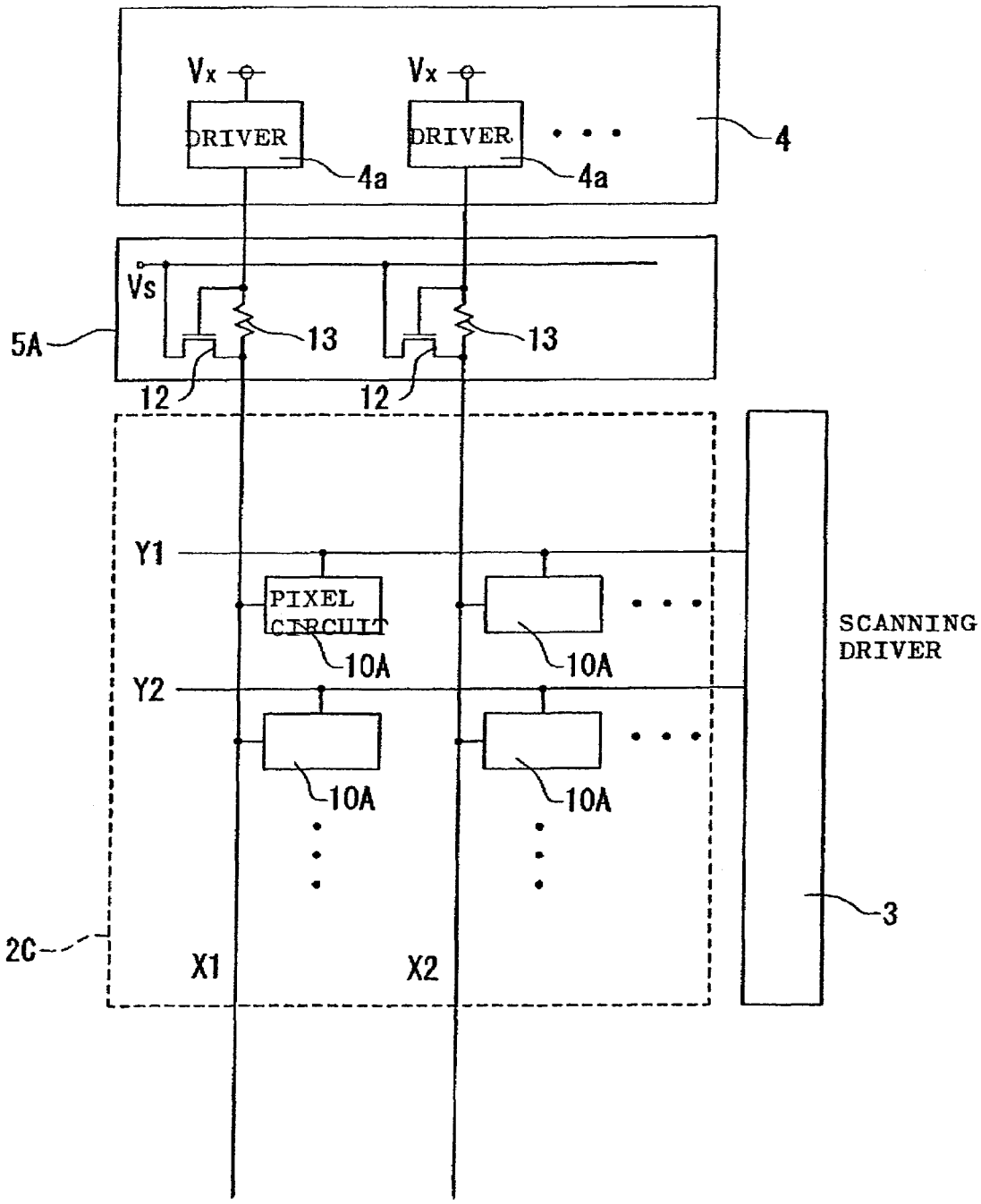

(FIG. 12)
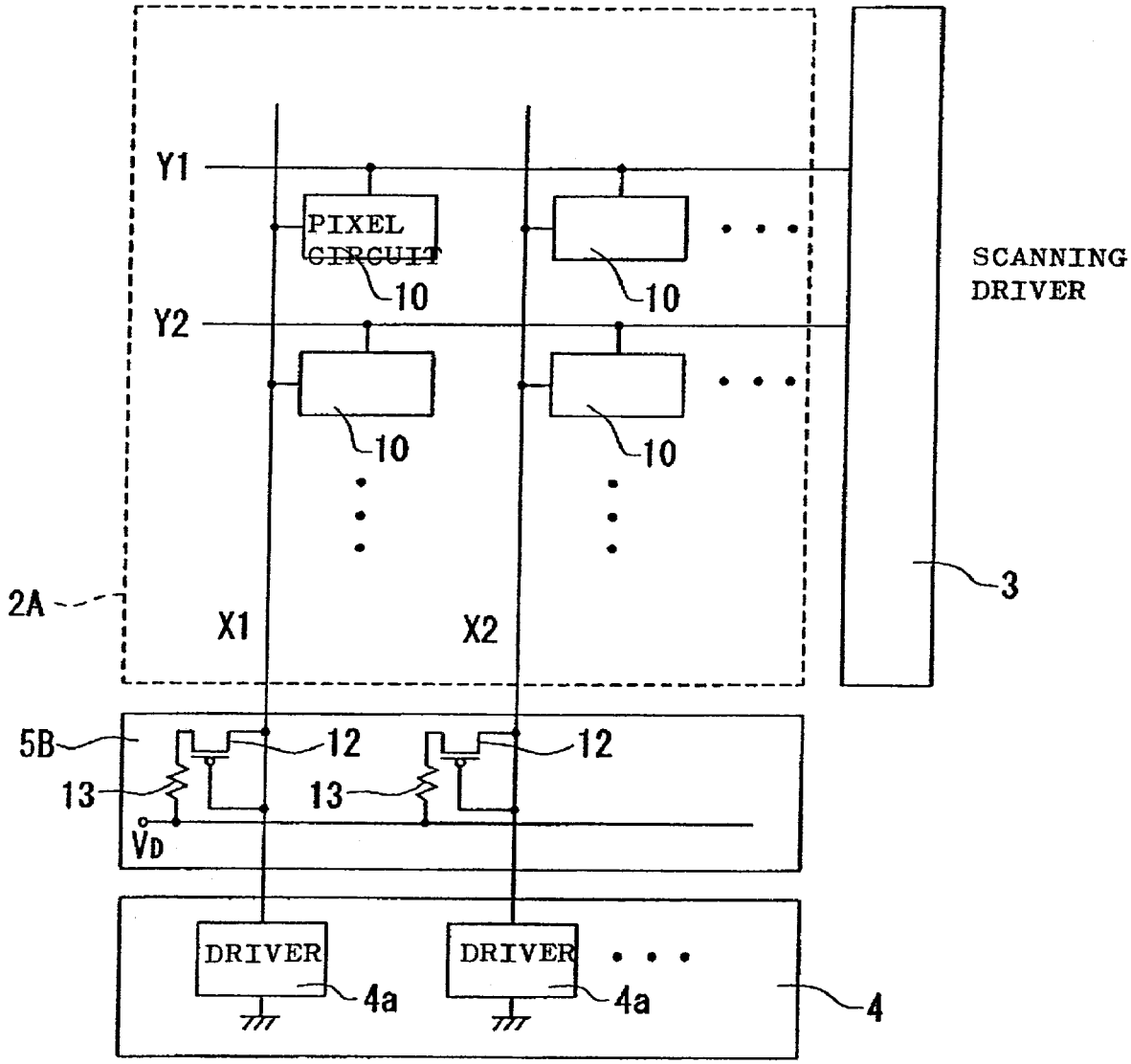

(FIG. 13)
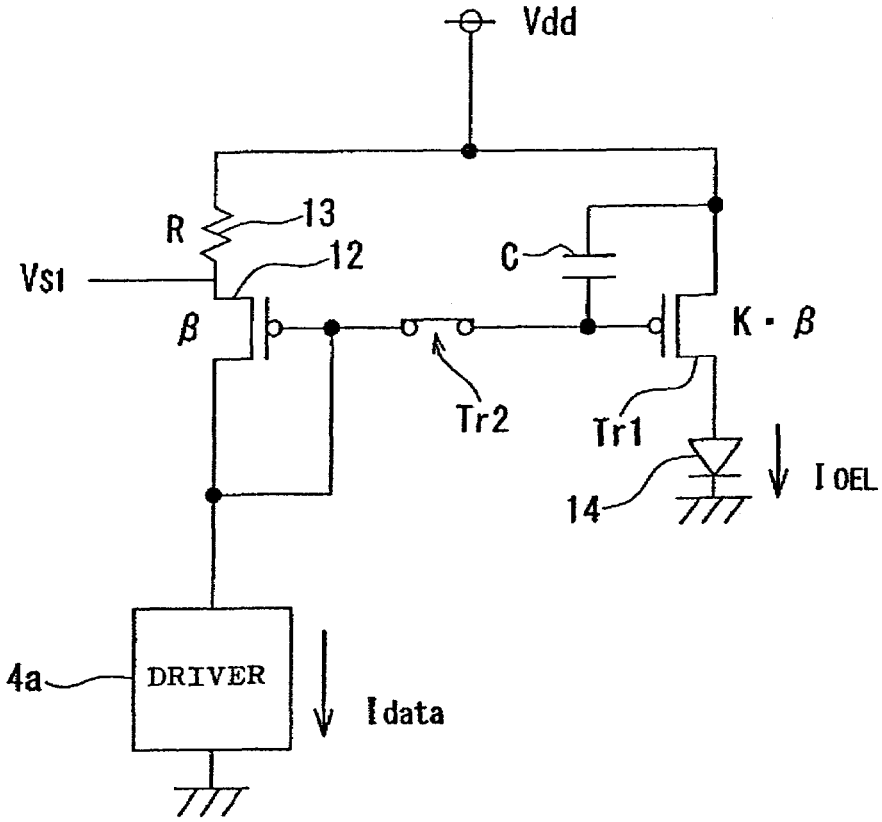
(FIG. 14)
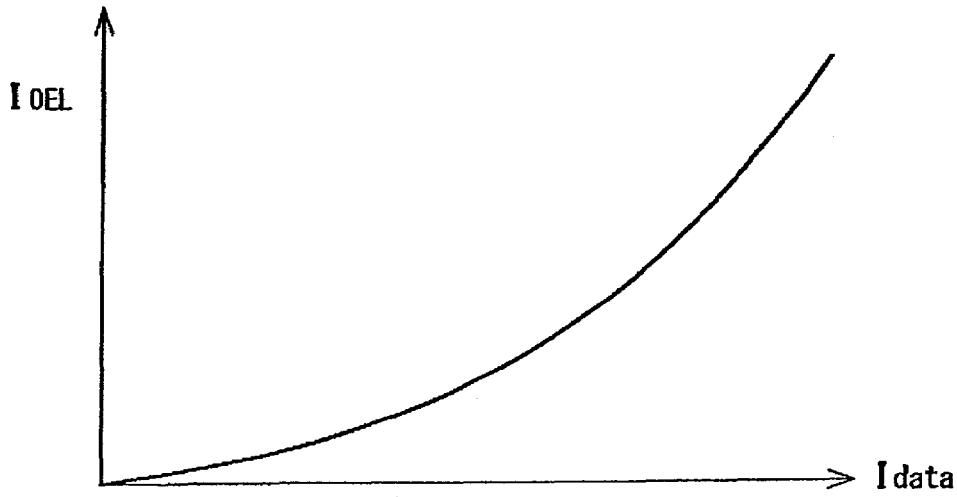

(FIG. 15)
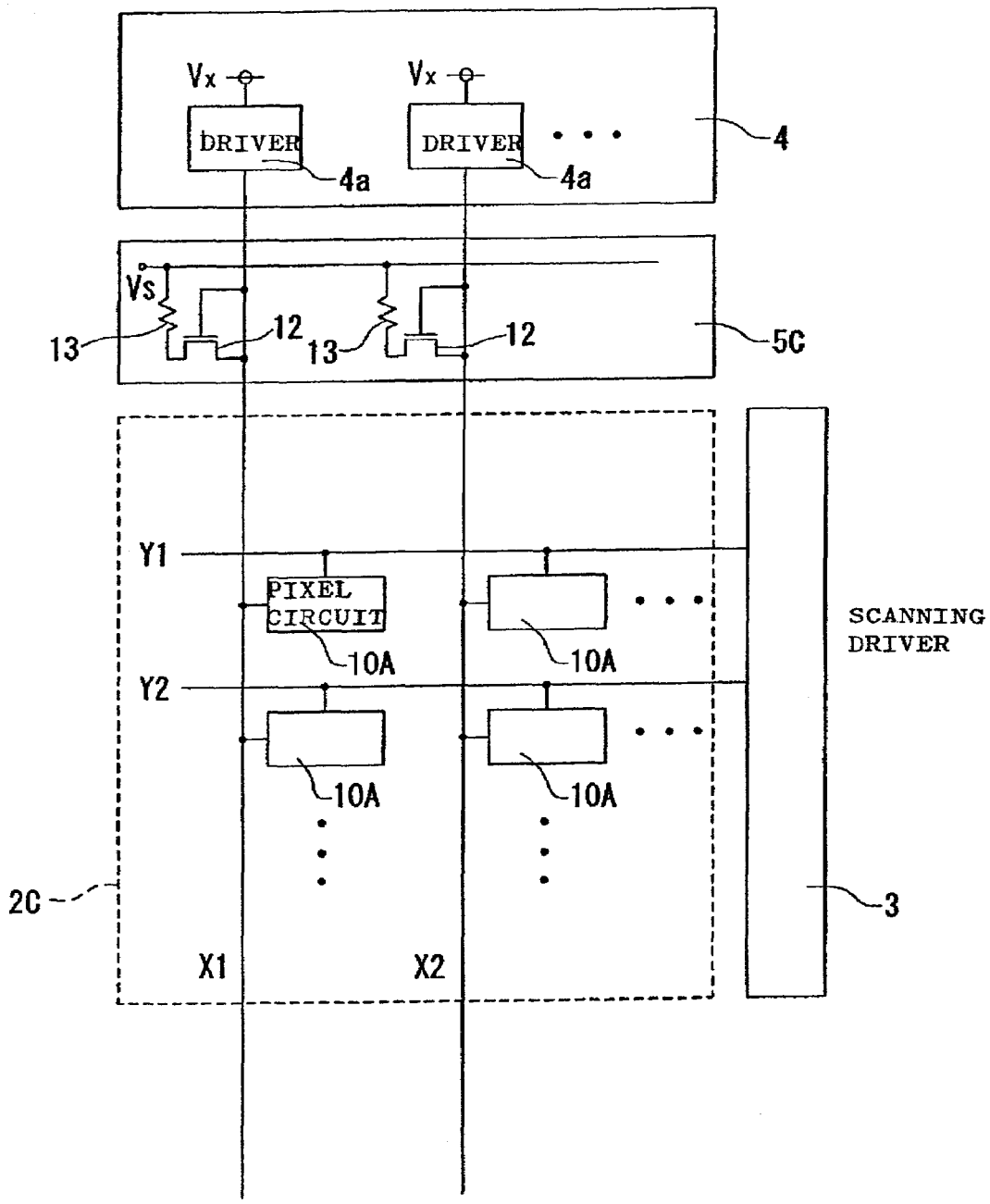

(FIG. 16)
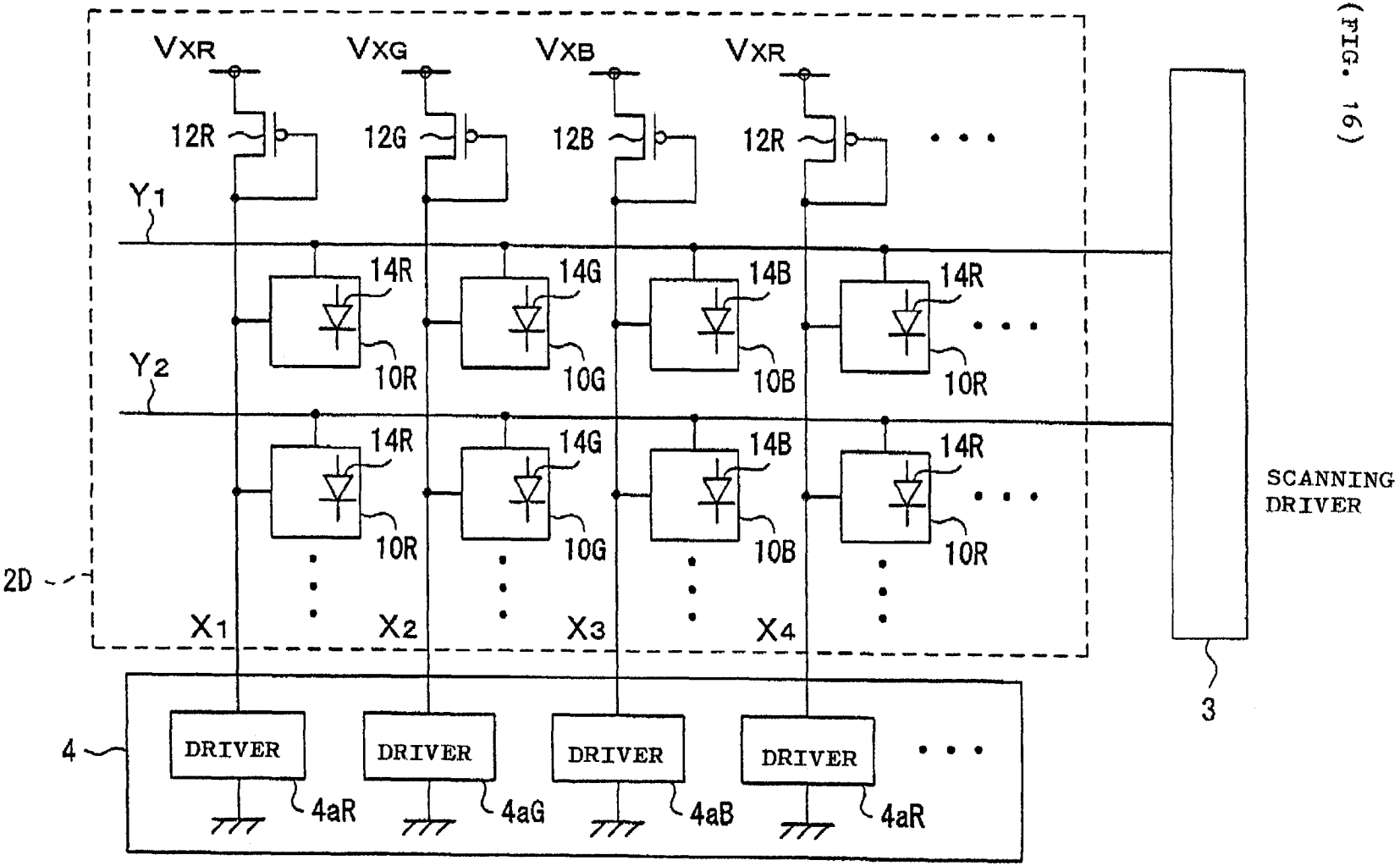

(FIG. 17)
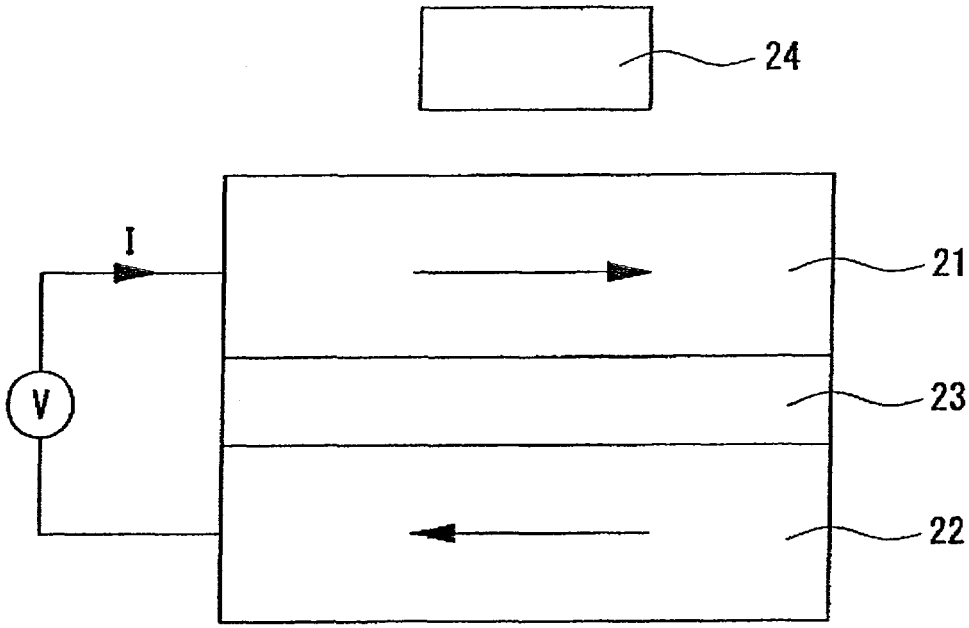
(FIG. 18)
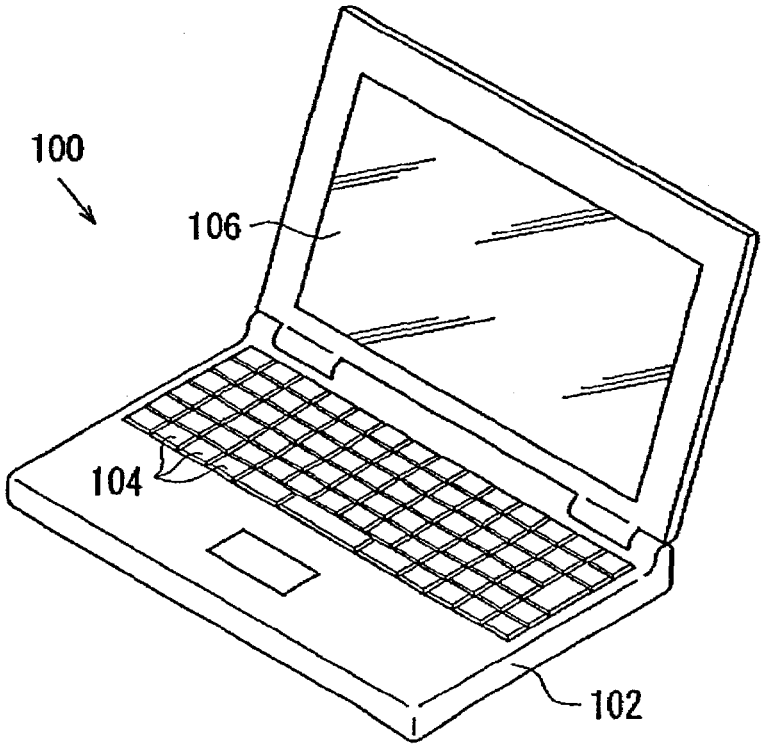

(FIG. 19)
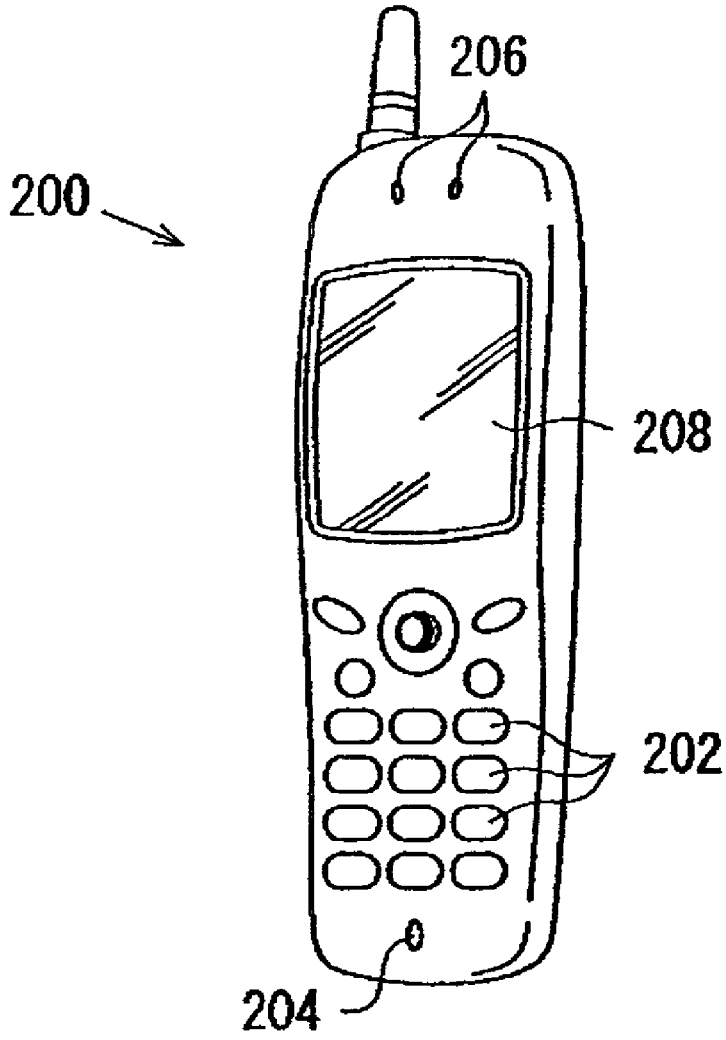

(FIG. 20)
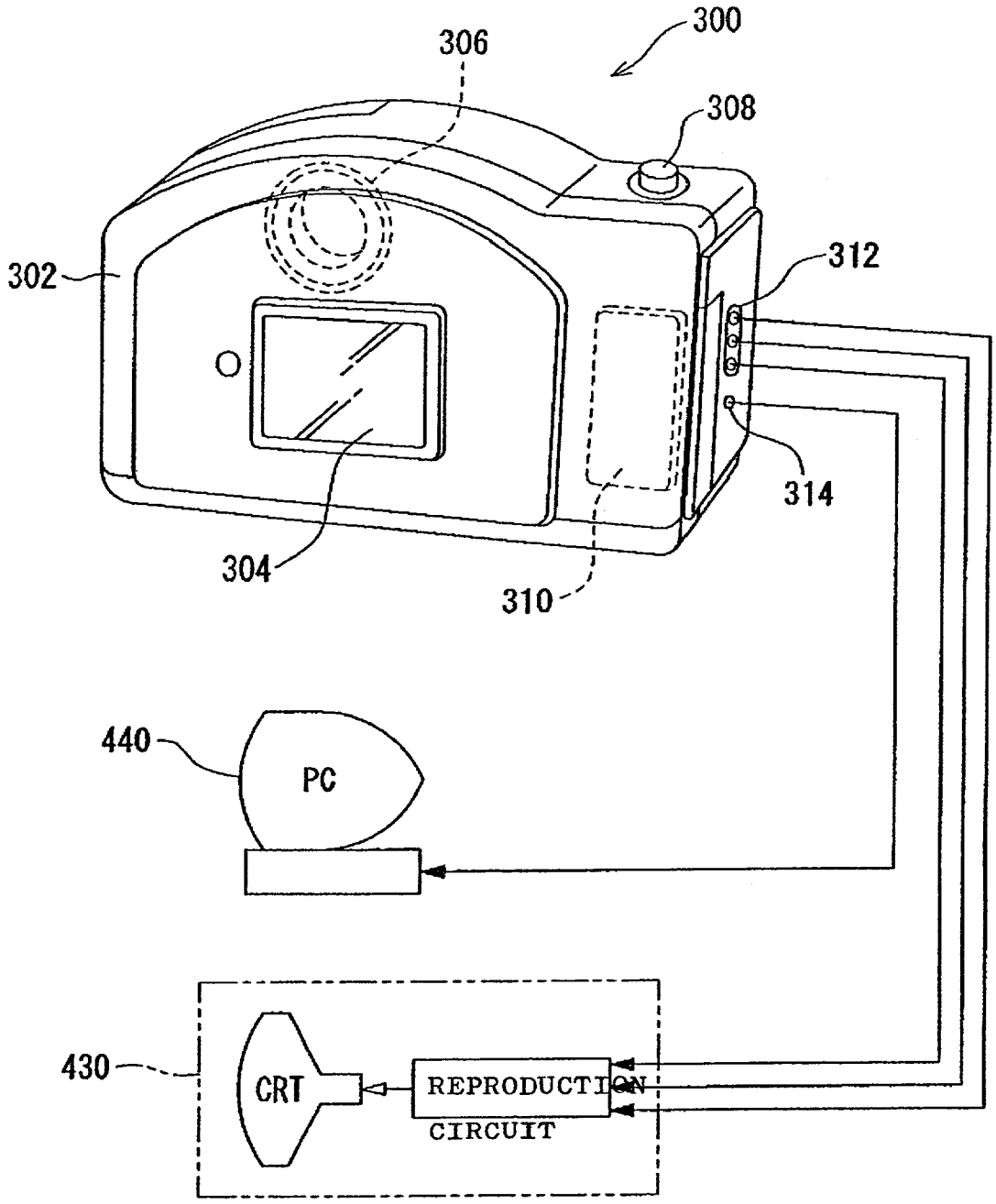

(FIG. 21)
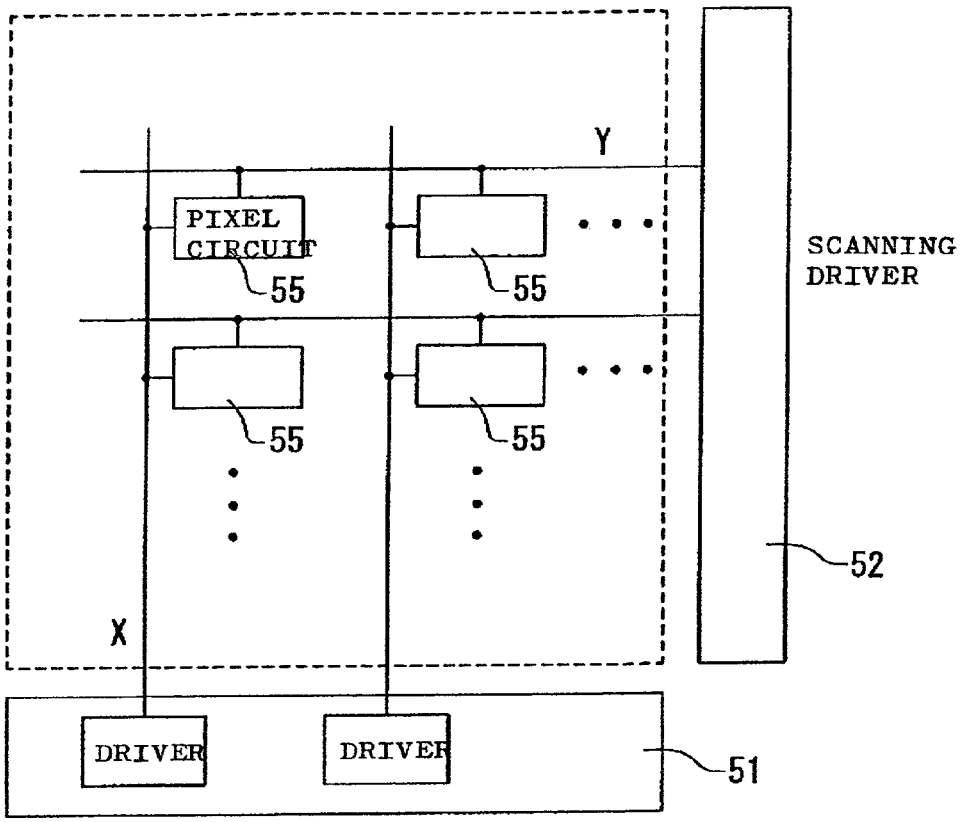
(FIG. 22)
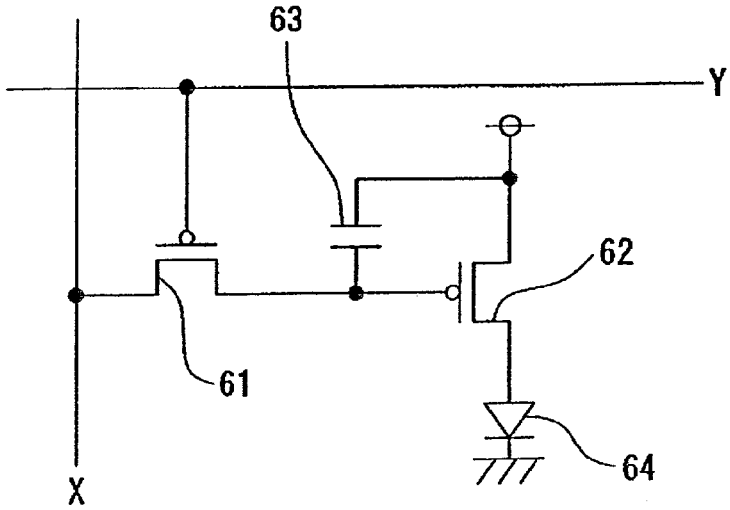

SYSTEM AND METHOD FOR MANUFACTURING A ELECTRO-OPTICAL DEVICE

BACKGROUND OF THE INVENTION

1. Field of Invention

The present invention relates to electronic devices, electro-optical devices, and electronic units having a current-driven device driven by electric current.

2. Description of Related Art

Currently, displays using liquid crystal have become quite popular as thin display apparatuses. This type of displays require lower power consumption and smaller spaces than CRT displays. Therefore, with the use of such display advantages, it is important to manufacture displays requiring lower power consumption and smaller spaces.

Some of the current displays use current-driven light-emitting devices instead of liquid crystal for display. Since the current-driven light-emitting devices emit light by themselves when current flows, unlike liquid crystal, the devices do not need backlight and can satisfy a market demand of low power consumption. In addition, the devices show superior display performances, such as a wide viewing angle and a high contrast. Among such current-driven light-emitting devices, electroluminescent devices are especially suited for displays because they can have a large area, a high definition, and full color. Further, among the electroluminescent devices, organic electroluminescent devices attract attentions because of their high quantum efficiency.

As such a display apparatus which uses an organic electroluminescent device, a display apparatus shown in FIG. 21 has been proposed. More specifically, in the display apparatus, pixel circuits are disposed correspondingly to the intersections of data lines X and scanning lines Y, the data lines are driven by a data driver 51, and the scanning lines Y are driven by the scanning driver 52.

The pixel circuit 55 is formed, for example, of two transistors 61 and 62, a capacitive device 63 for data storage, and an organic electroluminescent device 64, as shown in FIG. 22. A scanning line Y causes the transistor 61 to switch such that the capacitive device 63 holds a data signal sent from a data line X, as an electric charge. The electric charge held by the capacitive device 63 turns on the transistor 62, so that the amount of current corresponding to the data signal is supplied to the organic electroluminescent device 64. The organic electroluminescent device 64 emits light.

Current-driven devices, such as organic electroluminescent devices are more easily controlled by current than by a voltage. This results since the amount of current determines luminance in the organic electroluminescent devices, and therefore more accurate control is performed when current is used as a data signal.

SUMMARY OF THE INVENTION

An object of the present invention is to provide electronic apparatuses, electro-optical apparatuses, and electronic units in which the amount of current corresponding to a data signal, output to a data line or a wiring line, determines the amount of current which flows into a current-driven device.

To achieve the foregoing object, a first electronic apparatus according to the present invention can include a wiring line, a plurality of unit circuits connected to the wiring line, and a transistor connected to the wiring line, of which the gate voltage is specified according to the amount of current flowing through the wiring line. As such an electronic apparatus, an electronic apparatus having an MRAM (magnetoresistive RAM) cell, an organic electroluminescent device, or a laser diode can be taken.

A second electronic apparatus of the invention can include that the gate electrode of the transistor is connected to the source end or the drain end of the transistor in the electronic device described above. Through the present specification, the gate electrode of the transistor is connected to the source end or the drain end thereof also includes a case in which a resistive element, such as a transistor or a diode, is connected between the source end or the drain end and the gate electrode.

In the first and second electronic devices of the present invention, the gate voltage of the transistor connected to the wiring line is specified according to the amount of current flowing through the wiring line.

A third electronic device according to the present invention can include a wiring line, a plurality of unit circuits connected to the wiring line, and a first transistor connected to the wiring line, of which the gate voltage is specified according to the amount of current flowing through the wiring line. The unit circuit can include a second transistor for forming a current mirror with the first transistor.

A fourth electronic device according to the present invention is characterized in that the gate electrode of the first transistor is connected to the source end or the drain end of the first transistor in the electronic device.

In the third and fourth electronic device of the present invention, the gate voltage of the first transistor connected to the wiring line is specified according to the amount of current flowing through the wiring line, and the amount of current flowing through the second transistor is specified according to the gate voltage of the first transistor.

A fifth electronic device according to the present invention can include a wiring line, a plurality of unit circuits connected to the wiring line, and a first transistor connected to the wiring line, of which the gate voltage is specified according to the amount of current flowing through the wiring line. The unit circuit can include a second transistor having a "p" conductivity type, for forming a current mirror with the first transistor. With this, when an electronic device in which the second transistor is connected to an electronic element is formed, the electronic device can be easily formed according to the characteristics of the electronic device.

A sixth electronic device according to the present invention can include that the gate electrode of the first transistor is connected to the source end or the drain end of the first transistor in the electronic device.

A seventh electronic device according to the present invention can include a wiring line, a plurality of unit circuits connected to the wiring line, and a first transistor connected to the wiring line, of which the gate voltage is specified according to the amount of current flowing through the wiring line. The unit circuit can include a second transistor for forming a current mirror with the first transistor, and the gain coefficient of the second transistor is specified such that a larger amount of current is generated than the amount of current flowing through the wiring line. With this, the amount of current generated by the second transistor is made larger than the amount of current flowing through the wiring line.

An eighth electronic device according to the present invention can include a wiring line, a plurality of unit circuits connected to the wiring line, and a first transistor connected to the wiring line, of which the gate voltage is specified according to the amount of current flowing through the wiring line. The unit circuit can include a second transistor for forming a current mirror with the first transistor, and the gain coefficient of the second transistor is specified such that a smaller amount of current is generated than the amount of current flowing through the wiring line. With this, the amount of current generated by the second transistor is made smaller than the amount of current flowing through the wiring line.

A ninth electronic device can include that the gate electrode of the first transistor is connected to the source end or the drain end of the first transistor in the electronic device.

A first electro-optical device according to the present invention can include a data line, a plurality of unit circuits including an electro-optical device and connected to the wiring line, and a transistor connected to the data line, of which the gate voltage is specified according to the amount of current flowing through the data line.

A second electro-optical device further includes a scanning line, and is characterized in that each of the plurality of unit circuits includes a driving transistor electrically connected to the electro-optical device and a switching transistor of which the gate electrode is connected to the scanning line, and a data signal is sent to the plurality of unit circuits through the data line, in the electro-optical device.

A third electro-optical device according to the present invention is characterized in that the source end or the drain end of the switching transistor is connected to the gate electrode of the driving transistor in the electro-optical device.

A fourth electro-optical device according to the present invention can include that the data signal is current having an analog amount generated by a digital-analog conversion circuit in the electro-optical device.

A fifth electro-optical device according to the present invention can include that the transistor and the driving transistor form a current mirror in the electro-optical device.

A sixth electro-optical device according to the present invention can include that the voltage of a first power source connected to the data line and the voltage of a second power source connected to the electro-optical device through the driving transistor are specified so as to have a predetermined ratio in the electro-optical device described.

A seventh electro-optical device according to the present invention can include that the transistor is disposed between the digital-analog conversion circuit and the data line in the electro-optical device.

An eighth electro-optical device according to the present invention can include that the data line is disposed between the digital-analog conversion circuit and the transistor in the electro-optical device.

A ninth electro-optical device according to the present invention can include that the transistor, the digital-analog conversion circuit, and the data line are formed on the same base member in the electro-optical device.

A tenth electro-optical device according to the present invention can include that the data line and the digital-analog conversion circuit are formed on the same base member in the electro-optical device.

An eleventh electro-optical device according to the present invention can include that the data line and the transistor are formed on the same base member in the electro-optical device.

A twelfth electro-optical device according to the present invention can include that the digital-analog conversion circuit and the transistor are formed on the same base member in the electro-optical device.

In the present invention, the base member can be a glass substrate, a quartz substrate, or a silicon substrate.

A thirteenth electro-optical device according to the present invention can include that the transistor and the transistors included in the unit circuits are formed of thin-film transistors in the electro-optical device. When the transistors included in the unit circuits are formed of thin-film transistors in the thirteenth electro-optical device of the present invention, the transistors and the transistors included in the unit circuits formed of thin-film transistors can be formed as a unit on a base member, such as a glass substrate.

A fourteenth electro-optical device according to the present invention can include that the transistor is formed of a silicon-based MOS transistor in the electro-optical device described above. Transistor characteristics can be more easily controlled and the variations of the transistor characteristics can be more reduced in silicon-based MOS transistors than in thin-film transistors. When the transistor is a silicon-based MOS transistor and the unit circuit is formed of thin-film transistors, the transistor can be disposed in an external data-line IC driver. It is also possible that the transistor is manufactured on a wafer and the transistor is re-arranged on a base member on which the unit circuit is disposed.

The driving transistor needs to be electrically connected to the electro-optical device. Between these two devices, another transistor, for example, may be connected.

A fifteenth electro-optical device according to the present invention can include that the amount of current flowing through the data line, which specifies the amount of current flowing through the electro-optical device, is equal to or larger than the amount of current flowing through the electro-optical device in the electro-optical device described above. When the amount of current for supplying to the electro-optical device is small, it takes time to set the gate voltage of the transistor by outputting the current corresponding the amount to the data line. When the amount of current equal to or larger than that of current flowing through the electro-optical device is made to output to the data line, the gate voltage of the transistor is set within a shorter time.

A sixteenth electro-optical device according to the present invention can include that the amount of current flowing through the data line, which specifies the amount of current flowing through the electro-optical device, is equal to or smaller than the amount of current flowing through the electro-optical device in the electro-optical device described above. When the amount of current flowing through the data line, which specifies the amount of current flowing through the electro-optical device, is equal to or smaller than the amount of current flowing through the electro-optical device, power consumption is reduced.

A seventeenth electro-optical device according to the present invention can include a data line, a conversion transistor connected to the data line, of which the gate voltage is specified according to the amount of current of a data signal, flowing through the data line, and a unit circuit. The unit circuit can further include an electro-optical device and a driving transistor electrically connected to the electro-optical device and having a "p" conductivity type.

In the seventeenth electro-optical device according to the present invention, it is possible that the conversion transistor and the driving transistor are sufficiently turned on without adding a new power source.

An eighteenth electro-optical device according to the present invention can further include a scanning line, and is characterized in that each unit circuit includes a switching transistor of which the gate electrode is connected to the scanning line, and a data signal is sent to the plurality of unit circuits through the data line.

A nineteenth electro-optical device according to the present invention can include that the source end or the drain end of the switching transistor is connected to the gate electrode of the driving transistor in the electro-optical device described above.

A twentieth electro-optical device according to the present invention is characterized in that the data signal is current having an analog amount generated by a digital-analog conversion circuit in the electro-optical device described above.

A twenty-first electro-optical device according to the present invention is characterized in that the conversion transistor and the driving transistor form a current mirror in the electro-optical device described above.

A twenty-second electro-optical device according to the present invention is characterized in that the conversion transistor can be disposed between the digital-analog conversion circuit and the data line in the electro-optical device described above.

A twenty-third electro-optical device according to the present invention is characterized in that the data line can be disposed between the digital-analog conversion circuit and the conversion transistor in the electro-optical device described above.

A twenty-fourth electro-optical device according to the present invention is characterized in that the conversion transistor, the digital-analog conversion circuit, and the data line can be formed on the same base member in the electro-optical device described above.

A twenty-fifth electro-optical device according to the present invention is characterized in that the data line and the digital-analog conversion circuit can be formed on the same base member in the electro-optical device described above.

A twenty-sixth electro-optical device according to the present invention is characterized in that the data line and the conversion transistor can be formed on the same base member in the electro-optical device described above.

A twenty-seventh electro-optical device according to the present invention is characterized in that the digital-analog conversion circuit and the conversion transistor can be formed on the same base member in the electro-optical device described above.

In the twenty-fourth to twenty-seventh electro-optical devices of the present invention, the base member can be a glass substrate, a quartz substrate, or a silicon substrate can be used.

A twenty-eighth electro-optical device according to the present invention is characterized in that the conversion transistor, and the switching transistor and the driving transistor included in the unit circuit can be formed of thin-film transistors in the electro-optical device described above.

A twenty-ninth electro-optical device according to the present invention is characterized in that the conversion transistor can be formed of a silicon-based MOS transistor in the electro-optical device described above. Transistor characteristics can be more easily controlled and the variations of the transistor characteristics can be more reduced in silicon-based MOS transistors than in thin-film transistors. When the conversion transistor is a silicon-based MOS transistor and the unit circuit is formed of thin-film transistors, the conversion transistor can be disposed in an external data-line IC driver. It is also possible that the conversion transistor is manufactured on a wafer and the conversion transistor is re-arranged on a base member on which the unit circuit is disposed.

The driving transistor needs to be electrically connected to the electro-optical device. Another transistor, for example, may be connected between these components.

A thirtieth electro-optical device according to the present invention can include a data line, a conversion transistor connected to the data line, of which the gate voltage is specified according to the amount of current of a data signal flowing through the data line, and a unit circuit including a driving transistor which forms a current mirror with the conversion transistor and whose gain coefficient is specified such that a larger amount of current is generated than the amount of current of a data signal flowing through the data line, and an electro-optical device electrically connected to the driving transistor.

In the thirtieth electro-optical device of the present invention, when the amount of current for supplying to the electro-optical device is small, it takes time to set the gate voltage of the conversion transistor by outputting the current corresponding the amount to the data line. When the amount of current equal to or larger than that of current flowing through the electro-optical device is made to output to the data line, the gate voltage of the conversion transistor is set within a shorter time.

A thirty-first electro-optical device can include a data line, a conversion transistor connected to the data line, of which the gate voltage is specified according to the amount of current of a data signal flowing through the data line, and a unit circuit including a driving transistor which forms a current mirror with the conversion transistor and whose gain coefficient is specified such that a smaller amount of current is generated than the amount of current of a data signal flowing through the data line, and an electro-optical device electrically connected to the driving transistor.

In the thirty-first electro-optical device, when the amount of current flowing through the data line, which specifies the amount of current flowing through the electro-optical device, is equal to or smaller than the amount of current flowing through the electro-optical device, power consumption is reduced.

A thirty-second electro-optical device according to the present invention further includes a scanning line, and is characterized in that each of the plurality of unit circuits includes a switching transistor of which the gate electrode can be connected to the scanning line, and a data signal is sent to the plurality of unit circuits through the data line, in the electro-optical device described above.

A thirty-third electro-optical device according to the present invention is characterized in that the source end or the drain end of the switching transistor is connected to the gate electrode of the driving transistor in the electro-optical device described above.

A thirty-fourth electro-optical device according to the present invention is characterized in that the data signal is current having an analog amount generated by a digital-analog conversion circuit in the electro-optical device described above.

A thirty-fifth electro-optical device according to the present invention is characterized in that the conversion transistor and the driving transistor form a current mirror in the electro-optical device described above.

A thirty-sixth electro-optical device according to the present invention is characterized in that the conversion transistor can be disposed between the digital-analog conversion circuit and the data line in the electro-optical device described above.

A thirty-seventh electro-optical device according to the present invention is characterized in that the data line can be disposed between the digital-analog conversion circuit and the conversion transistor in the electro-optical device described above.

A thirty-eighth electro-optical device according to the present invention is characterized in that the conversion transistor, the digital-analog conversion circuit, and the data line are formed on the same base member in the electro-optical device described above.

A thirty-ninth electro-optical device according to the present invention is characterized in that the data line and the digital-analog conversion circuit can be formed on the same base member in the electro-optical device described above.

A fortieth electro-optical device according to the present invention is characterized in that the data line and the conversion transistor can be formed on the same base member in the electro-optical device described above.

A forty-first electro-optical device according to the present invention is characterized in that the digital-analog conversion circuit and the conversion transistor can be formed on the same base member in the electro-optical device described above.

A forty-second electro-optical device according to the present invention is characterized in that the conversion transistor, and the switching transistor and the driving transistor included in the unit circuit can be formed of thin-film transistors in the electro-optical device described above.

A forty-third electro-optical device according to the present invention is characterized in that the conversion transistor can be formed of a silicon-based MOS transistor in the electro-optical device described above.

A forty-fourth electro-optical device which includes a plurality of data lines for sending data signals and a plurality of unit circuits having electro-optical devices with different driving ranges for the amount of current of the data signals is characterized by including conversion transistors connected to the data lines and having gain coefficients corresponding to the driving ranges of the electro-optical devices; and driving transistors provided for the unit circuits, for forming current mirrors with the conversion transistors. The circuit structure of the electro-optical device does not need to be formed according to the characteristics of the electro-optical devices having the different driving ranges. Circuits having the same characteristics can be used.

A forty-fifth electro-optical device according to the present invention is characterized in that the electro-optical devices can be organic electroluminescent devices having light-emitting layers formed of organic materials which emit red, green, and blue light in the electro-optical device described above.

A forty-sixth electro-optical device according to the present invention further includes a scanning line, and is characterized in that each of the plurality of unit circuits includes a switching transistor of which the gate electrode can be connected to the scanning line in the electro-optical device described above.

A forty-seventh electro-optical device according to the present invention is characterized in that the data signal is current having an analog amount generated by a digital-analog conversion circuit in the electro-optical device described above.

A forty-eighth electro-optical device according to the present invention is characterized in that the conversion transistor is disposed between the digital-analog conversion circuit and the data line in the electro-optical device described above.

A fourth-ninth electro-optical device according to the present invention is characterized in that the data line can be disposed between the digital-analog conversion circuit and the conversion transistor in the electro-optical devices described above.

A fiftieth electro-optical device according to the present invention is characterized in that the conversion transistor, the digital-analog conversion circuit, and the data line are formed on the same base member in the electro-optical device described above.

A fifty-first electro-optical device according to the present invention is characterized in that the data line and the digital-analog conversion circuit can be formed on the same base member in the electro-optical device described above.

A fifty-second electro-optical device according to the present invention is characterized in that the data line and the conversion transistor can be formed on the same base member in the electro-optical device described above.

A fifty-third electro-optical device according to the present invention is characterized in that the digital-analog conversion circuit and the conversion transistor can be formed on the same base member in the electro-optical device described above.

A fifty-fourth electro-optical device according to the present invention is characterized in that the conversion transistors, and the switching transistors and the driving transistors included in the unit circuits can be formed of thin-film transistors in the electro-optical device described above.

A fifty-fifth electro-optical device according to the present invention is characterized in that the conversion transistors can be formed of silicon-based MOS transistors in the electro-optical device described above.

A fifty-sixth electro-optical device according to the present invention is characterized in that the electro-optical device can be an organic electroluminescent device in the electro-optical device described above.

An electronic apparatus according to the present invention is characterized by using the electro-optical device described above as a display section.

BRIEF DESCRIPTION OF THE DRAWINGS

The invention will be described with reference to the accompanying drawings wherein like numerals reference like elements, and wherein:

FIG. 1 is a block diagram showing an outlined structure of a display device to which the present invention is applied;

FIG. 2 is a block diagram showing an outlined structure of a main section of a display device according to a first embodiment of the present invention;

FIG. 3 is a circuit diagram showing an example pixel circuit in the first embodiment;

FIG. 4 is a block diagram showing an outlined structure of a main section of a display device according to a second embodiment;

FIG. 5 is a block diagram showing an outlined structure of a main section of a display device according to a third embodiment;

FIG. 6 is a circuit diagram showing an example pixel circuit in the third embodiment;

FIG. 7 is a block diagram showing an outlined structure of a main section of a display device according to a fourth embodiment;

FIG. 8 is a block diagram showing an outlined structure of a main section of a display device according to a fifth embodiment;

FIG. 9 is a circuit diagram used for describing an operation in the fifth embodiment;

FIG. 10 is a view used for describing an operation in the fifth embodiment;

FIG. 11 is a block diagram showing an outlined structure of a main section of a display device according to a sixth embodiment;

FIG. 12 is a block diagram showing an outlined structure of a main section of a display device according to a seventh embodiment;

FIG. 13 is a circuit diagram used for describing an operation in the seventh embodiment;

FIG. 14 is a view used for describing an operation in the seventh embodiment;

FIG. 15 is a block diagram showing an outlined structure of a main section of a display device according to an eighth embodiment;

FIG. 16 is a block diagram showing an outlined structure of a main section of a display device according to a ninth embodiment;

FIG. 17 is a structural view showing an outlined structure of a magnetoresistive RAM to which an electro-optical device according to the present invention is applied;

FIG. 18 is a perspective view showing the structure of a personal computer serving as an example electronic apparatus to which an electro-optical device according to the present invention is applied;

FIG. 19 is a perspective view showing the structure of a portable telephone serving as an example electronic apparatus to which an electro-optical device according to the present invention is applied;

FIG. 20 is a perspective view showing the structure of a digital still camera at its rear side, serving as an example electronic apparatus to which an electro-optical device according to the present invention is applied;

FIG. 21 is a block diagram showing an example conventional display device; and FIG. 22 is a circuit diagram showing an example conventional pixel circuit.

DETAILED DESCRIPTION OF PREFERRED EMBODIMENTS

FIG. 1 is a block diagram showing an outlined structure of a display device to which an electro-optical device according to the first embodiment is applied. The display device includes a controller 1 for generating data to be displayed on a display and data related to display. The controller 1 controls a scanning driver 3 for driving scanning lines connected to the gate electrodes of transistors included in a display panel 2, and a data driver 4 for driving data lines connected to the sources or drains of the transistors included in the display panel 2. The controller 1 also controls the driving timing of the scanning lines and data lines.

In the display panel 2, as shown in FIG. 2, a plurality of scanning lines Yn driven by the scanning driver 3 and a plurality of data lines Xm driven by the data driver 4 are disposed perpendicularly to each other. Pixel circuits 10 are provided correspondingly to their intersections.

As shown in FIG. 2, a power source Vx is disposed at the opposite end of where a driver 4*a* for driving each data line Xm is disposed, and a conversion transistor 12 is connected between the power source Vx and the data line Xm. The conversion transistor 12 is a diode-connected p-type transistor. The gate voltage of the conversion transistor 12 is determined according to the amount of current flowing through the data line Xm via the driver 4*a*, correspondingly to a data signal.

The pixel circuit 10 can be formed, as shown in FIG. 3, of an organic electroluminescent device 14 serving as an electro-optical device, a driving transistor Tr1 for driving the organic electroluminescent device 14, a control transistor Tr2 for driving the driving transistor Tr1, and a capacitive device C for holding the data of the data line Xm.

In the present embodiment, the transistors Tr1 and Tr2 and the conversion transistor 12 are TFTs (thin film transistors). The pixel circuits 10, the data lines Xm, the scanning lines Yn, and the conversion transistors 12 are formed on an insulating substrate as a unit.

The driving transistor Tr1 is, for example, a p-channel transistor. One end of the driving transistor Tr1 is connected to a power source Vdd, and the other end is connected to the organic electroluminescent device 14. The other end of the organic electroluminescent device 14 is connected to a ground potential Vss. The driving transistor Tr1 and the conversion transistor 12 form a current mirror.

The control transistor Tr2 is, for example, a n-channel transistor. One end thereof is connected to a data line Xm, and the other end is connected to the gate electrode of the driving transistor Tr1 and to the capacitive device C. The gate electrode of the control transistor Tr2 is connected to a scanning line Yn.

One end of the capacitive device C is connected to a power source Vc. The power source Vc is set, for example, to the potential of the driving power source Vdd, to the ground potential Vss, or to a desired potential.

With such a structure, when the control transistor Tr2 is turned on by a scanning-line driving signal, the electric charge corresponding to the potential of the data line Xm is stored in the capacitive device C, the electric charge turns on the driving transistor Tr1, and the amount of current corresponding to the amount of the electric charge stored in the capacitive device C is sent to the organic electroluminescent device 14.

The data line Xm, the pixel circuit 10, the conversion transistor 12, the driving transistor Tr1, the control transistor Tr2, the power source Vx, and the power source Vdd correspond to a wiring line and a data line, a unit circuit, a transistor or a first transistor, a second transistor or a driving transistor, a switching transistor, a first power source, and a second power source described in claims. A digital-analog conversion circuit described in claims is included in the data driver 4.

The amount of current output to the data line Xm can be controlled by setting the characteristic ratio of the conversion transistor 12 and the driving transistor Tr1 or the potential of the power source Vdd. More specifically, when Vdd is set to Vx, if the gain coefficient of the conversion transistor 12 is set larger than that of the driving transistor Tr1, the amount of current output to the data line Xm is made larger. Therefore, electric charges can be stored in the capacitive device C at a high speed. In contrast, if the gain coefficient of the conversion transistor 12 is set smaller than that of the driving transistor Tr1, the amount of current output to the data line Xm is made smaller. Therefore, power consumption is reduced.

When the characteristic ratio of the driving transistor Tr1 to the conversion transistor 12 is uniform in a pixel area 2, for example, a predetermined amount of current is sent to the organic electroluminescent device 14 in the amount of current output to the data line Xm. As a result, control can be made such that luminance is uniform in the plane, and the display quality is improved.

A common conversion transistor 12 is used for pixel circuits 10 connected to one data line. Since the driving transistor Tr1 of each pixel circuit 10 and the common conversion transistor 12 form a current mirror circuit, it is not necessary to provide a conversion transistor 12 for each pixel circuit 10, and hence, the number of devices constituting the pixel circuit 10 is reduced.

In the first embodiment, the control transistor Tr2 of the pixel circuit 10 is an n-channel transistor, having an n-type conductivity. However, it should be understood that the present invention is not limited to this case. Definitely, the control transistor may be a p-channel transistor, having a p-type conductivity.

In the first embodiment, the conversion transistor 12 and the driving transistor Tr1 are p-channel transistors. The source of the conversion transistor 12 and that of the driving transistor Tr1 are connected to the power source Vx and the power source Vdd, respectively. When the threshold voltage of the conversion transistor 12 and that of the driving transistor Tr1 are equally Vth, if the power source Vx and the power source Vdd are equal to Vth or higher, it is necessary to set the gate voltages of the conversion transistor 12 and the driving transistor Tr1 to a voltage which the drains of the transistors can have, or lower in order to sufficiently turn on the transistors. Since the voltage which the drains of both transistors can have is the ground potential Vss, if a voltage of Vss is applied as the gate voltages of both transistors, the transistors can be sufficiently turned on. When the conversion transistor 12 and the driving transistor Tr1 are n-channel transistors, it is necessary to apply Vx+Vth and Vdd+Vth as the gate voltages to sufficiently turn on both transistors. This means that an additional power source is required, and the cost of the display device increases.

In the first embodiment, the scanning driver 3 and the data driver 4 may be formed of thin-film transistors or silicon-based MOS transistors. When the scanning driver 3 and the data driver 4 are formed of thin-film transistors, the drivers can be formed on an insulating substrate such as a glass substrate as a unit. When the scanning driver 3 and the data driver 4 are formed of silicon-based MOS transistors, these transistors usually serve as external IC drivers. These drivers can be re-arranged on an insulating substrate.

A second embodiment of the present invention will be described next.

The second embodiment is the same as the first embodiment except that the structure of the pixel area 2 is different. The same symbols as those used in the first embodiment are assigned to the same portions as those described in the first embodiment, and detailed descriptions thereof are omitted.

As shown in FIG. 4, a conversion transistor 12 is disposed at the side of a data driver 4 along each data line Xm. In the same way as in the first embodiment, the conversion transistor 12 is diode-connected, the gate electrode and the drain electrode thereof are connected to the data line Xm, and the source electrode is connected to a power source VD.

The gate voltage of the conversion transistor 12 is specified according to the amount of current output from the data driver 4 to each data line Xm. The gate voltage determines the amount of current supplied to an organic electroluminescent device 14. Also in the second embodiment, the same effects and advantages are obtained as those in the first embodiment.

A data driver 4 may be formed of thin-film transistors. The data driver 4 may also be formed of silicon-based MOS transistors. The conversion transistor 12 may be a thin-film transistor. It may also be a silicon-based MOS transistor. When the conversion transistor 12 is a silicon-based MOS transistor, the conversion transistor 12 and the data driver 4 can be integrated as an IC driver. When the conversion transistor 12 is a silicon-based MOS transistor, since the transistor characteristic of each conversion transistor can be made uniform, the amount of current supplied to the organic electroluminescent device 14 can be controlled more precisely.

A third embodiment of the present invention will be described next.

The third embodiment is the same as the first embodiment except that the structure of the pixel area 2 is different. The same symbols as those used in the first embodiment are assigned to the same portions as those described in the first embodiment, and detailed descriptions thereof are omitted.

As shown in FIG. 5, in a pixel area 2B of the third embodiment, a data driver 4 is provided at a power-source Vx side, and a conversion transistor 12 is disposed at the opposite end of where the data driver 4 for a data line Xm is disposed. The conversion transistor 12 is an n-channel transistor.

A pixel circuit 10A of the third embodiment is configured as shown in FIG. 6. More specifically, a driving transistor Tr1A of the third embodiment is an n-channel transistor. An organic electroluminescent device 14 is disposed between a power source Vdd and the driving transistor Tr1A. The gate electrode of the driving transistor Tr1A is connected to one end of a control transistor Tr2.

Also in this case, a power source Vc is set to the potential of the power source Vdd, to the ground potential Vss, or to a desired potential.

The gate voltage of the conversion transistor 12 is specified according to the amount of current corresponding to a data signal, output to each data line Xm through the data driver 4. The amount of electric charges corresponding to the gate voltage is accumulated in a capacitive device C. The driving transistor Tr1A is turned on according to the amount of electric charges to make current flow into the organic electroluminescent device 14.

Therefore, also in this case, the same effects and advantages as those in the first embodiment are obtained. Also in this case, in the same way as in the first embodiment, a scanning driver 3 and the data driver 4 may be formed of either thin-film transistors, or silicon-based MOS transistors.

The control transistor Tr2 constituting the pixel circuit 10A may be an n-channel or p-channel transistor.

A fourth embodiment will be described next.

The fourth embodiment is the same as the third embodiment except that the structure of the pixel area 2 is different. The same symbols as those used in the third embodiment are assigned to the same portions as those described in the third embodiment, and detailed descriptions thereof are omitted.

In a pixel area 2C of the fourth embodiment, as shown in FIG. 7, pixel circuits 10A are provided correspondingly to the intersections of data lines Xm and scanning lines Yn. A conversion transistor 12 is disposed adjacently to a data driver 4 and at the data-driver 4 side of each data line Xm.

The conversion transistor 12 is diode-connected in the same way as in the third embodiment.

A scanning driver 3 drives a scanning line Y1, the gate voltage of the conversion transistor 12 is specified according to the amount of current corresponding to a data signal, output to each data line Xm through the data driver 4, and the amount of electric charges corresponding to the gate voltage is accumulated in a capacitive device. A driving transistor Tr1A is turned on according to the amount of accumulated electric charges to make current flow into an organic electroluminescent device 14.

Also in this case, the data driver 4 may be formed of either thin-film transistors, or silicon-based MOS transistors. In some cases, a silicon-based MOS transistor is more suited to control the amount of current at a high precision.

A fifth embodiment will be described next.

The fifth embodiment is implemented when the ratio of the amount of current output to the data line Xm to the amount of current supplied to the organic electroluminescent device 14 of the pixel circuit 10 is changed in the second embodiment.

A current-voltage conversion circuit 5 is inserted between a pixel area 2A and a data driver 4. The current-voltage conversion circuit 5 is formed, as shown in FIG. 8, of a conversion transistor 12 of which the drain end is connected to a data line Xm and the source end is connected to a driving power source VD, and a resistor 13 inserted between the point where the data line Xm and the drain end connect, and a driver 4*a*. The potential of a point between the resistor 13 and the driver 4*a* is connected to the gate electrode of the conversion transistor 12.

When the driving power source VD is equal to a driving power source Vdd, for example, each pixel circuit 10 and the current-voltage conversion circuit 5 can be illustrated as shown in FIG. 9.

If the threshold voltage of the conversion transistor 12 is equal to that of a driving transistor Tr1, and each transistor operates in its saturation area, the following expressions (1) to (3) are satisfied.

$$I\text{data}=(1/2)\cdot\beta\cdot(Vdd-VG1-VTH)^2 \quad (1)$$

$$IOEL=(1/2)\cdot k\beta\cdot(Vdd-VG2-VTH)^2 \quad (2)$$

$$VG2-VG1=R\cdot I\text{data} \quad (3)$$

In the expressions, Idata indicates the amount of current output from the driver 4*a*, β shows a coefficient (gain coefficient) indicating the current supply capability of a transistor, VG1 indicates the potential of a point between the resistor 13 and the driver 4*a*, VTH indicates the threshold voltage of the conversion transistor 12 and the driving transistor Tr1, IOEL indicates the value of current supplied to the organic electroluminescent device 14, k shows a constant indicating the current ratio of Idata and IOEL, VG2 indicates the potential of a point between the conversion transistor 12 and the resistor 13, and R indicates the resistance of the resistor 13.

From the expressions (1) to (3), the following expression (4) is satisfied.

$$IOEL=0.5k\cdot\beta\cdot R^2\cdot I\text{data}\ \{I\text{data}^{0.5}-2^{0.5}/(R\beta^{0.5})\}^2 \quad (4)$$

Therefore, since the relationship between Idata and IOEL can be set to that shown in a characteristic view of FIG. 10 from the expression (4), when Idata is used in a region of $1/(2R2\cdot\beta)\leqq I\text{data}\leqq 2/(R2\cdot\beta)$, the change of Idata and that of IOEL are set opposite.

Also in this case, a scanning driver 3, the data driver 4, and the current-voltage conversion circuit 5 may be formed of either thin-film transistors or silicon-based MOS transistors. The data driver 4 and the current-voltage conversion circuit 5 may be formed as a unit.

A sixth embodiment will be described next.

In the sixth embodiment, as shown in FIG. 11, a data driver 4 and a current-voltage conversion circuit 5A are inserted between a power source Vx and a pixel area 2C.

The pixel area 2C is configured such that pixel circuits 10A are disposed correspondingly to the intersections of data lines Xm and scanning lines Yn.

The current-voltage conversion circuit 5A is formed, as shown in FIG. 11, of an n-channel conversion transistor 12 and a resistor 13. The source end of the conversion transistor 12 is connected to a power source Vs, and the drain end is connected to a data line Xm. The gate electrode of the conversion transistor 12 is connected to a point between the driver 4*a* and the point where the data line Xm and the drain end connect. Further, the resistor 13 is connected between the point where the data line Xm and the gate electrode of the conversion transistor 12 connect and the point where the data line Xm and the drain electrode connect.

Therefore, also in this case, the same operation as that in the fifth embodiment is performed, and the same effects and advantages as those in the fifth embodiment are obtained.

A seventh embodiment will be described next.

In the seventh embodiment, as shown in FIG. 12, a current-voltage conversion circuit 5B is inserted between a pixel area 2A and a data driver 4.

The pixel area 2A is formed of pixel circuits 10 disposed correspondingly to the intersections of data lines Xm and scanning lines Yn.

The current-voltage conversion circuit 5B is formed, as shown in FIG. 12, of a p-channel conversion transistor 12 and a resistor 13. The source end of the conversion transistor 12 is connected to a data line Xm, and the resistor 13 is inserted between the drain end thereof and a driving power source VD. The gate electrode of the conversion transistor 12 is connected between the point wherethe data line Xm and the source end connect, and a driver 4*a*.

When the power source VD is equal to a power source Vdd, for example, each pixel circuit 10 and the current-voltage conversion circuit 5 can be illustrated as shown in FIG. 13.

If the threshold voltage of the conversion transistor 12 is equal to that of a driving transistor Tr1, and each transistor operates in its saturation area, the following expressions (5) to (7) are satisfied.

$$I\text{data}=(1/2)\cdot\beta\cdot(VS1-VG-VTH)^2 \quad (5)$$

$$IOEL=(1/2)\cdot\beta\cdot(Vdd-VG-VTH)^2 \quad (6)$$

$$Vdd-VS1=R\cdot I\text{data} \quad (7)$$

In the expressions, Idata indicates the amount of current output from the driver 4*a*, β shows a coefficient (gain coefficient) indicating the current supply capability of a transistor, VS1 indicates the potential of a point between the resistor 13 and the driver 4*a*, VTH indicates the threshold voltage of the conversion transistor 12 and the driving transistor Tr1, IOEL indicates the value of current supplied to the organic electroluminescent device 14, k shows a constant indicating the current ratio of Idata and IOEL, and R indicates the resistance of the resistor 13.

From the expressions (5) to (7), the following expression (8) is satisfied.

$$IOEL=0.5k\cdot\beta\cdot\{R\cdot I\text{data}+(I\text{data}\cdot 2/\beta)^{0.5}\}^2 \quad (8)$$

Therefore, the relationship between Idata and IOEL can be shown in a characteristic view of FIG. 14 from the expression (8). Consequently, a non-linear relationship can be made between ΔIdata and ΔIOEL, and ΔIOEL can be changed larger than the change of the amount Idata of output current.

An eighth embodiment will be described next.

In the eighth embodiment, as shown in FIG. 15, a current-voltage conversion circuit 5C is inserted between a data driver 4 and a pixel area 2C.

The pixel area 2C is formed of pixel circuits 10A disposed correspondingly to the intersections of data lines Xm and scanning lines Yn.

The current-voltage conversion circuit 5C is formed, as shown in FIG. 15, of an n-channel conversion transistor 12 and a resistor 13. The drain end of the conversion transistor 12 is connected to a data line Xm, and the resistor 13 is inserted between the source and a power source Vs. The gate electrode of the conversion transistor 12 is connected between the point where the data line Xm and the drain end of the conversion transistor 12 connect, and a driver 4*a*.

Therefore, also in this case, since the amount of current flowing through a driving transistor Tr1A of the pixel circuit 10A is larger than the amount of current output from the driver 4*a* in the same way as in the seventh embodiment, the same effects and advantages as those in the seventh embodiment are obtained.

In the fifth to eighth embodiments, the current-voltage conversion circuit 5 may be formed of either thin-film transistors or silicon-based MOS transistors. In addition, the data driver 4 and the current-voltage conversion circuit 5 may be formed as a unit.

A ninth embodiment will be described next.

In the ninth embodiment, an electro-optical device according to the present invention is applied to a full-color display. The ninth embodiment is the same as the first embodiment except that the structure of the pixel area 2 is different. The same symbols as those used in the first embodiment are assigned to the same portions as those described in the first embodiment, and detailed descriptions thereof are omitted.

FIG. 16 is a block diagram indicating an outlined structure of a main section in a display device according to the ninth embodiment. As shown in FIG. 16, in a pixel area 2D, red, green, and blue pixel circuits 10R, 10G, and 10B having color organic electroluminescent devices 14R, 14G, and 14B which have light-emitting layers formed of organic materials which emit red, green, and blue light are sequentially and repeatedly disposed along scanning lines Yn. In the pixel area 2D, the pixel circuits 10R, 10G, and 10B for the same colors are provided along data lines Xm. In other words, the red pixel circuits 10R are connected to data lines X1, X4, X7, . . . . The green pixel circuits 10G are connected to data lines X2, X5, X8, . . . . The blue pixel circuits 10B are connected to data lines X3, X6, X9, . . . .

The data lines X1, X4, X7, . . . , connected to the red pixel circuits OR, are connected to red conversion transistors 12R. The gain coefficients of the red conversion transistors 12R are specified such that a current range is generated as a driving range in which the red organic electroluminescent devices 14R emit light. The red conversion transistors 12R are connected to a red power source VxR for supplying a voltage which drives the red conversion transistors 12R. The data lines X1, X4, X7, . . . , connected to the red pixel circuits 10R, are also connected to red drivers 4*a*R for driving the data lines X1, X4, X7, . . . , disposed at the end opposite where the red power source VxR is located. In other words, the data lines X1, X4, X7, . . . are disposed between the red drivers 4*a*R and the red conversion transistors 12R.

The data lines X2, X5, X8, . . . , connected to the green pixel circuits 10G, are connected to green conversion transistors 12G. The gain coefficients of the green conversion transistors 12G are specified such that a current range is generated as a driving range in which the green organic electroluminescent devices 14G emit light. The green conversion transistors 12G are connected to a green power source VxG for supplying a voltage which drives the green conversion transistors 12G. The data lines X2, X5, X8, . . . , connected to the green pixel circuits 10G, are also connected to green drivers 4*a*G for driving the data lines X2, X5, X8, . . . , disposed at the end opposite where the green power source VxG is located. In other words, the data lines X2, X5, X8, . . . are disposed between the green drivers 4*a*G and the green conversion transistors 12G.

The data lines X3, X6, X9, . . . , connected to the blue pixel circuits 10B, are connected to blue conversion transistors 12B. The gain coefficients of the blue conversion transistors 12B are specified such that a current range is generated as a driving range in which the blue organic electroluminescent devices 14B emit light. The blue conversion transistors 12B are connected to a blue power source VxB for supplying a voltage which drives the blue conversion transistors 12B. The data lines X3, X6, X9, . . . , connected to the blue pixel circuits 10B, are also connected to blue drivers 4*a*B for driving the data lines X3, X6, X9, . . . , disposed at the end opposite where the blue power source VxB is located. In other words, the data lines X3, X6, X9, . . . are disposed between the blue drivers 4*a*B and the blue conversion transistors 12B.

The red, green, and blue conversion transistors 12R, 12G, and 12B are p-channel transistors.

In the electro-optical device having the pixel area 2D structured in this way, when the gain coefficients of the color conversion transistors 12R, 12G, and 12B are adjusted, the current ranges where the color organic electroluminescent devices 14R, 14G, and 14B emit light are adjusted, as described above.

Therefore, it is not necessary that the color drivers 4*a*R, 4*a*G, and 4*a*B have circuits with different characteristics according to the characteristics of the color organic electroluminescent devices 14R, 14G, and 14B. All the drivers can be formed of circuits having the same characteristics. The places where the conversion transistors 12R, 12G, and 12B are disposed in FIG. 15 are not limited to those shown in the present embodiment. For example, they may be disposed at the places shown in the second to eighth embodiments.

In each of the above-described embodiments, the scanning driver 3 and the data driver 4 may be formed of either thin-film transistors or silicon-based MOS transistors.

In each of the above-described embodiments, the present invention is applied to the display device in which the pixel circuits 10 or 10A are arranged in matrix. The present invention can also be applied to any cases in which pixel circuits are arranged in any shape.

In each of the above-described embodiments, the organic electroluminescent device is used. The present invention is not limited to this case. A circuit structure according to the present invention can also be applied to an electronic device having a device which emits light when driven by current, such as a light-emitting diode (LED), a laser diode (LD), or a field-emission (FE) device. In addition, a circuit structure according to the present invention can further be applied to an electronic device having a non-light-emitting, current-driven device, such as a magnetoresistive RAM.

A magnetoresistive RAM is, for example, configured such that a barrier layer 23 formed of an insulating member is sandwiched by two electrodes 21 and 22 formed of ferromagnetic metal layers, as shown in FIG. 17. When tunnel current flows through the barrier layer 23 between the electrodes 21 and 22, the amount of the tunnel current is changed according to the direction of magnetization of the upper and lower ferromagnetic metals. This phenomenon is used for storage. More specifically, one electrode 22 is used as a reference layer and its direction of magnetization is fixed. The other electrode 21 is used as a data recording layer. Current is caused to flow through a writing electrode 24. The magnetic field generated by the current changes the direction of magnetization of the electrode 21, serving as the data recording layer, to record information. To read recorded information, current is caused to flow in the opposite direction through the writing electrode 24 to electrically read the change of the tunnel resistance.

The organic electroluminescent device can be applied, for example, to mobile personal computers, portable telephones, and digital still cameras.

FIG. 18 is a perspective view showing the structure of a mobile personal computer.

In FIG. 18, a personal computer 100 can be formed of a body section 104 having a keyboard 102, and a display unit 106 formed of an organic electroluminescent device to which the electro-optical device is applied.

FIG. 19 is a perspective view of a portable telephone. In FIG. 19, a portable telephone 200 is formed of a plurality of operation buttons 202, a receiver 204, a transmitter 206, and a display panel 208 formed of an organic electroluminescent device to which the electro-optical device is applied.

FIG. 20 is a perspective view showing the structure of a digital still camera 300. Connections to external units are also shown in a simple manner. Whereas usual cameras use film which is exposed to light by the optical image of a subject to be captured, the digital still camera 300 uses an image capture device such as a CCD (charge coupled device) to apply electro-optical conversion to the optical image of a subject to be captured to generate an image signal. At the rear surface of the case 302 of the digital still camera 300, a display panel 304 formed of an organic electroluminescent device to which the above-described electro-optical device is applied is provided. The display panel 304 executes a display function according to an image signal generated by the CCD. Therefore, the display panel 304 functions as a finder for displaying a subject to be captured. At the observation side (at the back side of the figure) of the case 302, a light receiving unit 306 which includes an optical lens and the CCD is provided.

When the user checks the image of a subject to be captured, displayed on the display panel 304 and presses a shutter button 308, the image signal of the CCD generated at that point is transferred to and stored in a memory on a printed circuit board 310. The digital still camera 300 is provided with a video-signal output terminal 312 and a data-communication input-and-output terminal 314 at a side of the case 302. As shown in the figure, the video-signal output terminal 312 is connected to a TV monitor 430, and the data-communication input-and-output terminal 314 is connected to a personal computer 440, as required. Further, with a predetermined operation, the image signal stored in the memory on the printed circuit board 310 is output to the TV monitor 430 or to the personal computer 440.

In addition to the personal computer shown in FIG. 18, the portable telephone shown in FIG. 19, and the digital still camera shown in FIG. 20, electronic units include TV sets, viewfinder or monitor-direct-viewing video cassette recorders, car navigation devicees, pagers, electronic pocket books, electronic calculators, wordprocessors, workstations, video phones, POS terminals, and units having touch-sensitive panels. A display device formed of the above-described electro-optical device can be applied to a display section of the above various electronic apparatuses.

According to the present invention, driving control of electro-optical devices by current driving can be performed at a high precision and the number of components can be reduced.

The invention claimed is:

1. An electronic device, comprising:

a wiring line;

a plurality of unit circuits connected to the wiring line;

a first transistor connected to the wiring line, of which a gate voltage is specified according to the amount of current flowing through the wiring line; and a resistor which is connected one of (a) between a gate electrode and a drain end of the first transistor or (b) between a drain end of the first transistor and a driving power source, each unit circuit including a second transistor having a "p" conductivity type, that forms a current mirror with the first transistor, and the second transistor connected to an electroluminescent device, wherein a unit circuit for emitting one of red, green or blue light is connected to a wiring line and a first transistor for a single color in order that as a gain coefficient of the single color unit circuit is adjusted, light emitted from a color electroluminescent device of the unit circuit is separately adjusted for each color.

2. An electronic device according to claim 1, having the gate electrode of the first transistor connected to at least one of a source end and a drain end of the first transistor.

3. An electronic device, comprising:

a wiring line;

a plurality of unit circuits connected to the wiring line;

a first transistor connected to the wiring line, of which the gate voltage is specified according to the amount of current flowing through the wiring line; and a resistor which is connected one of (a) between a gate electrode and a drain end of the first transistor or (b) between a drain end of the first transistor and a driving power source, each unit circuit comprising a second transistor that forms a current mirror with the first transistor, the second transistor connected to an electroluminescent device, and a gain coefficient of the second transistor being specified such that a larger amount of current is generated than the amount of current flowing through the wiring line, wherein a unit circuit for emitting one of red, green or blue light is connected to a wiring line and a first transistor for a single color in order that as a gain coefficient of the single color unit circuit is adjusted, light emitted from a color electroluminescent device of the unit circuit is separately adjusted for each color.

4. An electronic device according to claim 3, having the gate electrode of the first transistor connected to at least one of a source end and a drain end of the first transistor.

5. An electronic device, comprising:

a wiring line;

a plurality of unit circuits connected to the wiring line;

a first transistor connected to the wiring line, of which a gate voltage is specified according to the amount of current flowing through the wiring line; and a resistor which is connected one of (a) between a gate electrode and a drain end of the first transistor or (b) between a drain end of the first transistor and a driving power source, each unit circuit including a second transistor that forms a current mirror with the first transistor, the second transistor connected to an electroluminescent device, and a gain coefficient of the second transistor being specified such that a smaller amount of current is generated than the amount of current flowing through the wiring line, wherein a unit circuit for emitting one of red, green or blue light is connected to a wiring line and a first transistor for a single color in order that as a gain coefficient of the single color unit circuit is adjusted, light emitted from a color electroluminescent device of the unit circuit is separately adjusted for each color.

6. An electro-optical device, comprising:

a wiring line;

a plurality of unit circuits comprising an electroluminescent device and connected to the wiring line;

a transistor connected to the wiring line of which a gate voltage is specified according to the amount of current flowing through the wiring line; and a resistor which is connected one of (a) between a gate electrode and a drain end of the transistor or (b) between a drain end of the transistor and a driving power source, wherein a unit circuit for emitting one of red, green or blue light is connected to a wiring line and a transistor for a single color in order that as a gain coefficient of the single color unit circuit is adjusted, light emitted from a color electroluminescent device of the unit circuit is separately adjusted for each color.

7. An electro-optical device according to claim 6, further comprising:

a scanning line, each of the plurality of unit circuits including a driving transistor electrically connected to the electroluminescent device and a switching transistor of which the gate electrode is connected to the scanning line, and a data signal is sent to the plurality of unit circuits through the data line.

8. An electro-optical device according to claim 7, at least one of a source end and a drain end of the switching transistor being connected to the gate electrode of the driving transistor.

9. An electro-optical device according to claim 7, the data signal being current having an analog amount generated by a digital-analog conversion circuit.

10. An electro-optical device according to claim 9, forming the voltage of a first power source connected to the data line and the voltage of a second power source connected to the electroluminescent device through the driving transistor being specified so as to have a predetermined ratio.

11. An electro-optical device according to claim 9, the transistor being disposed between the digital-analog conversion circuit and the data line.

12. An electro-optical device according to claim 11, the transistor, the digital-analog conversion circuit, and the data line being formed on the same base member.

13. An electro-optical device according to claim 11, the data line and the digital-analog conversion circuit being formed on the same base member.

14. An electro-optical device according to claim 11, the data line and the transistor being formed on the same base member.

15. An electro-optical device according to claim 11, the digital-analog conversion circuit and the transistor being formed on the same base member.

16. An electro-optical device according to claim 9, the data line being disposed between the digital-analog conversion circuit and the transistor.

17. An electro-optical device according to claim 7, the transistor and the driving transistor forming a current mirror.

18. An electro-optical device according to claim 7, the transistor and the transistors included in the unit circuits being formed of thin-film transistors.

19. An electro-optical device according to claim 6, the transistor being formed of a silicon-based MOS transistor.

20. An electro-optical device according to claim 6, the amount of current flowing through the data line, which specifies the amount of current flowing through the electroluminescent device, being equal to or larger than the amount of current flowing through the electroluminescent device.

21. An electro-optical device according to claim 6, the amount of current flowing through the data line, which specifies the amount of current flowing through the electroluminescent device, being equal to or smaller than the amount of current flowing through the electroluminescent device.

22. An electronic apparatus having an electro-optical device described in claim 6 as a display section.

23. An electro-optical device, comprising:

a data line;

a conversion transistor connected to the data line, of which a gate voltage is specified according to an amount of current of a data signal flowing through the data line;

a resistor which is connected one of (a) between a gate electrode and a drain end of the conversion transistor or (b) between a drain end of the conversion transistor and a driving power source; and a unit circuit comprising an electroluminescent device and a driving transistor electrically connected to the electroluminescent device and having a "p" conductivity type, wherein a unit circuit for emitting one of red, green or blue light is connected to a data line and a conversion transistor for a single color in order that as a gain coefficient of the single color unit circuit is adjusted, light emitted from a color electroluminescent device of the unit circuit is separately adjusted for each color.

24. An electro-optical device according to claim 23, further comprising:

a scanning line, the unit circuit including a switching transistor of which the gate electrode is connected to the scanning line, and a data signal is sent to the unit circuit through the data line.

25. An electro-optical device according to claim 24, at least one of a source end and a drain end of the switching transistor being connected to the gate electrode of the driving transistor.

26. An electro-optical device according to claim 24, the conversion transistor, and the switching transistor and the driving transistor included in the unit circuit being formed of thin-film transistors.

27. An electro-optical device according to claim 23, the data signal being current having an analog amount generated by a digital-analog conversion circuit.

28. An electro-optical device according to claim 27, the conversion transistor being disposed between the digital-analog conversion circuit and the data line.

29. An electro-optical device according to claim 28, the data line and the conversion transistor being formed on the same base member.

30. An electro-optical device according to claim 28, the digital-analog conversion circuit and the conversion transistor being formed on the same base member.

31. An electro-optical device according to claim 27, the data line being disposed between the digital-analog conversion circuit and the conversion transistor.

32. An electro-optical device according to claim 31, the data line and the digital-analog conversion circuit being formed on the same base member.

33. An electro-optical device according to claim 27, the conversion transistor, the digital-analog conversion circuit, and the data line being formed on the same base member.

34. An electro-optical device according to claim 23, the conversion transistor and the driving transistor forming a current mirror.

35. An electro-optical device according to claim 23, the conversion transistor being formed of a silicon-based MOS transistor.

36. An electro-optical device, comprising:

a data line;

a conversion transistor connected to the data line, of which a gate voltage is specified according to the amount of current of a data signal flowing through the data line;

a resistor which is connected one of (a) between a gate electrode and a drain end of the conversion transistor or (b) between a drain end of the conversion transistor and a driving power source, and a unit circuit comprising:

a driving transistor which forms a current mirror with the conversion transistor and whose gain coefficient is specified such that a larger amount of current is generated than an amount of current of a data signal flowing through the data line; and an electroluminescent device electrically connected to the driving transistor, wherein a unit circuit for emitting one of red, green or blue light is connected to a data line and a conversion transistor for a single color in order that as a gain coefficient of the single color unit circuit is adjusted, light emitted from a color electroluminescent device of the unit circuit is separately adjusted for each color.

37. An electro-optical device according to claim 36, further comprising:

a scanning line, the unit circuit including a switching transistor of which the gate electrode is connected to the scanning line, and a data signal is sent to the unit circuit through the data line.

38. An electro-optical device according to claim 37, at least one of a source end and a drain end of the switching transistor being connected to the gate electrode of the driving transistor.

39. An electro-optical device according to claim 37, the conversion transistor, and the switching transistor and the driving transistor included in the unit circuit being formed of thin-film transistors.

40. An electro-optical device according to claim 36, the data signal being current having an analog amount generated by a digital-analog conversion circuit.

41. An electro-optical device according to claim 40, the conversion transistor being disposed between the digital-analog conversion circuit and the data line.

42. An electro-optical device according to claim 41, the data line and the conversion transistor being formed on the same base member.

43. An electro-optical device according to claim 41, the digital-analog conversion circuit and the conversion transistor being formed on the same base member.

44. An electro-optical device according to claim 40, the data line being disposed between the digital-analog conversion circuit and the conversion transistor.

45. An electro-optical device according to claim 44, the data line and the digital-analog conversion circuit being formed on the same base member.

46. An electro-optical device according to claim 40, the conversion transistor, the digital-analog conversion circuit, and the data line being formed on the same base member.

47. An electro-optical device according to claim 36, the conversion transistor and the driving transistor forming a current mirror.

48. An electro-optical device according to claim 36, the conversion transistor being formed of a silicon-based MOS transistor.

49. An electro-optical device, comprising:

a data line;

a conversion transistor connected to the data line, of which a gate voltage is specified according to the amount of current of a data signal flowing through the data line;

a resistor which is connected one of (a) between a gate electrode and a drain end of the conversion transistor or (b) between a drain end of the conversion transistor and a driving power source, and a unit circuit comprising:

a driving transistor which forms a current mirror with the conversion transistor and whose gain coefficient is specified such that a smaller amount of current is generated than an amount of current of a data signal flowing through the data line; and an electroluminescent device electrically connected to the driving transistor, wherein a unit circuit for emitting one of red, green or blue light is connected to a data line and a conversion transistor for a single color in order that as a gain coefficient of the single color unit circuit is adjusted, light emitted from a color electroluminescent device of the unit circuit is separately adjusted for each color.

50. An electro-optical device, comprising:

a plurality of data lines that send data signals; and a plurality of unit circuits having electroluminescent devices with different driving ranges corresponding to emitted red, green and blue light for an amount of current of the data signals, comprising:

conversion transistors connected between a driving power source and the data lines and having gain coefficients corresponding to the driving ranges of electroluminescent devices;

resistors which are connected one of (a) between a gate electrode and a drain end of a conversion transistor or (b) between a drain end of a conversion transistor and the driving power source, and driving transistors provided for the unit circuits, that form current mirrors with the conversion transistors, wherein unit circuits for emitting one of red, green and blue light are connected separately to data lines and conversion transistors for single colors in order that as gain coefficients of single color unit circuits are adjusted, light emitted from color electroluminescent devices of the unit circuits is separately adjusted for each color.

51. An electro-optical device according to claim 50, the electroluminescent devices being organic electroluminescent devices having light-emitting layers formed of organic materials which emit the red, green, and blue light.

52. An electro-optical device according to claim 50, further comprising:

a scanning line, each of the unit circuits including a switching transistor of which the gate electrode is connected to the scanning line.

53. An electro-optical device according to claim 52, the conversion transistors, and the switching transistors and the driving transistors included in the unit circuits being formed of thin-film transistors.

54. An electro-optical device according to claim 50, the data signal being current having an analog amount generated by a digital-analog conversion circuit.

55. An electro-optical device according to claim 54, the data line and the digital-analog conversion circuit being formed on the same base member.

56. An electro-optical device according to claim 54, the data line and the conversion transistor being formed on the same base member.

57. An electro-optical device according to claim 54, the digital-analog conversion circuit and the conversion transistor being formed on the same base member.

58. An electro-optical device according to claim 50, the conversion transistor being disposed between the digital-analog conversion circuit and the data line.

59. An electro-optical device according to claim 50, the data line being disposed between the digital-analog conversion circuit and the conversion transistor.

60. An electro-optical device according to claim 50, the conversion transistor, the digital-analog conversion circuit, and the data line being formed on the same base member.

61. An electro-optical device according to claim 50, the conversion transistors being formed of silicon-based MOS transistors.

62. An electro-optical device according to claim 50, the electro-optical device being an organic electroluminescent device.

* * * * *